United States Patent [19]

Johnston et al.

[11] Patent Number: 4,462,535

[45] Date of Patent: Jul. 31, 1984

[54] APPARATUS AND PROCESS FOR MANUFACTURE OF TUNNEL TUBES

[75] Inventors: Edward Johnston, Newark, Del.; Morton Jacobs, Houston, Tex.; Melvin E. Miller, Havre de Grace, Md.; Robert A. Kaucic, Newark, Del.

[73] Assignee: AMCA International Corporation, Hanover, N.H.

[21] Appl. No.: 518,668

[22] Filed: Aug. 26, 1983

Related U.S. Application Data

[62] Division of Ser. No. 256,710, Apr. 23, 1981, Pat. No. 4,418,561.

[51] Int. Cl.[3] ..... B23K 31/02

[52] U.S. Cl. ..... 228/184; 29/559; 29/423; 29/426.3; 29/469; 269/48.1; 405/136; 228/151

[58] Field of Search ..... 72/367, 369, 308, 310, 72/478, 482, 406, 368; 405/136, 137, 178; 242/100.2, 117, 55, 54 R; 254/359, 372, 312; 228/184, 182, 151, 44 R; 269/48.1; 29/559, 455 R, 423, 426.3, 469; 425/110, 468

[56] References Cited

U.S. PATENT DOCUMENTS

| | | | |
|---|---|---|---|
| 813,211 | 2/1906 | Jacobs | 254/312 |
| 974,288 | 11/1910 | McCarroll | 72/406 |
| 1,340,297 | 5/1920 | Schiff | 242/117 |
| 2,547,946 | 4/1951 | Jessen | 425/468 |
| 2,708,782 | 5/1955 | Jessen | 425/468 |
| 2,878,545 | 3/1959 | Lowe | 425/468 |
| 2,878,770 | 3/1959 | Work et al. | 269/48.1 |
| 3,022,562 | 2/1962 | Card | 425/468 |
| 3,109,477 | 9/1962 | Avera et al. | 72/482 |
| 4,088,007 | 5/1978 | Clavin | 269/48.1 |
| 4,233,020 | 11/1980 | Oswald | 269/48.1 |

*Primary Examiner*—Daniel C. Crane
*Assistant Examiner*—David B. Jones
*Attorney, Agent, or Firm*—Harness, Dickey & Pierce

[57] ABSTRACT

This invention relates to improved apparatus and process for manufacture of tunnel modules and tunnel sections used to build underwater tunnel tubes. A collapsible fixture is used to roll up a steel plate into a cylindrical shell. Cables wrapped around channels on the outer ends of fixtures are use to roll up the fixture along the plate. After the fixture with the shell on it is placed on pedestals for further fabrication, cables placed in the channels are used to rotate the shells. After the fixture is collapsed within the shell, it is raised up by pedestal lifting mechanisms, and wheels provided on the fixture are lowered into place to aid in removal of the fixture from the shell, and onto a roll-out table. Roller mechanisms are also used to aid in the removal of the fixture from the shell. The roll-out table is situated between two sets of pedestals and used in the removal of fixtures from single modules or sets of modules. A common winch is utilized to pull out the fixture onto the table from each shell module.

5 Claims, 36 Drawing Figures

FIG. 1.
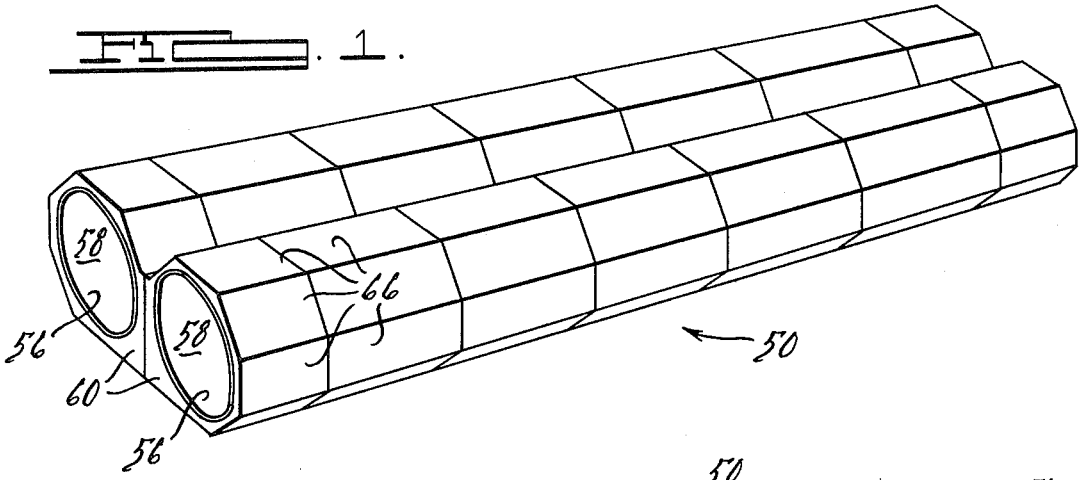
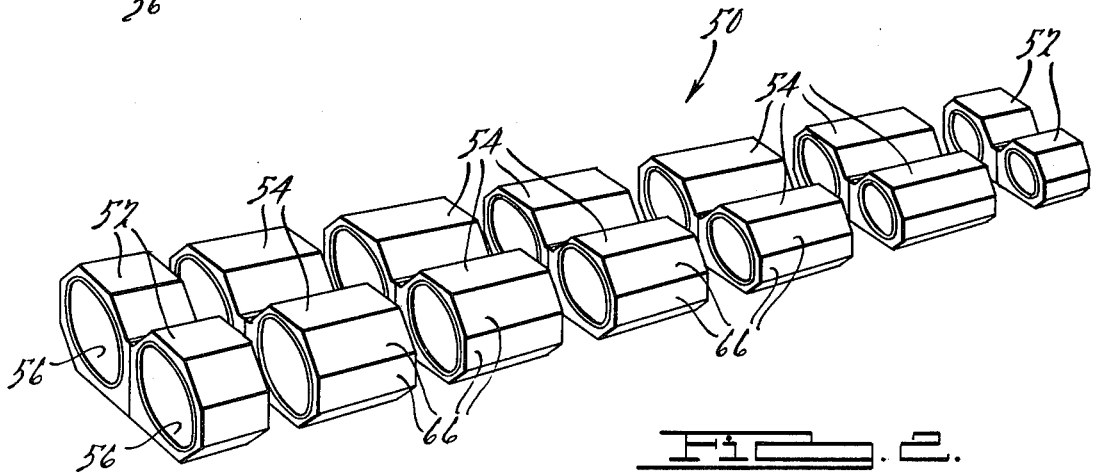
FIG. 2.
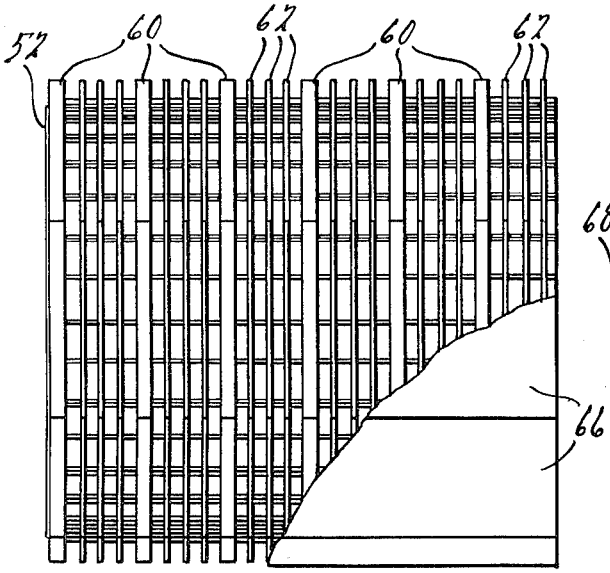
FIG. 3.
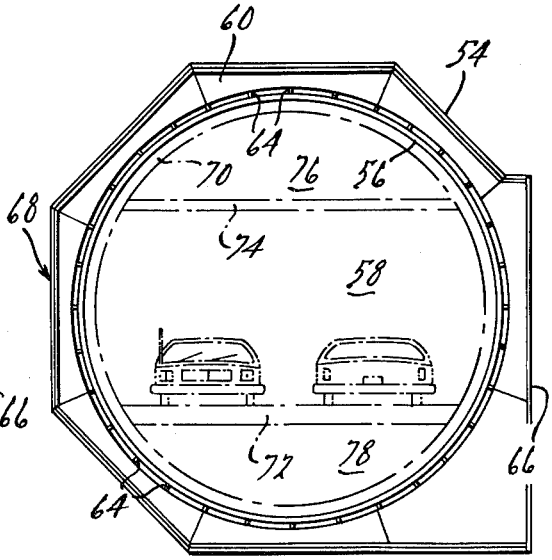
FIG. 4.

FIG. 9.
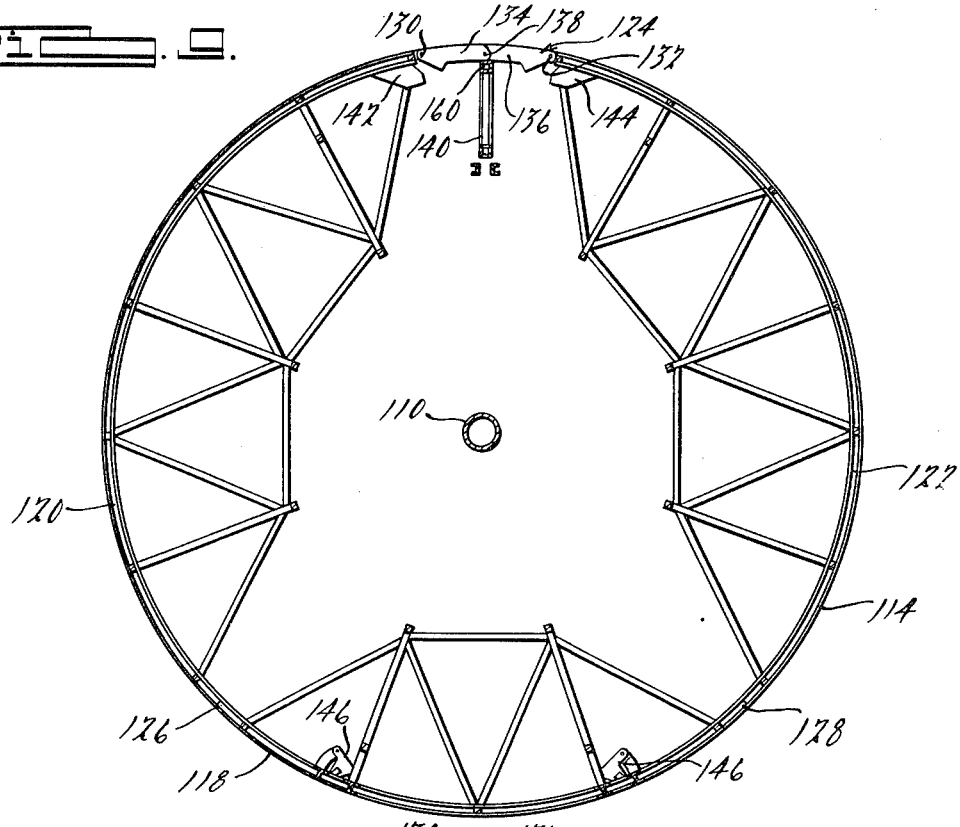
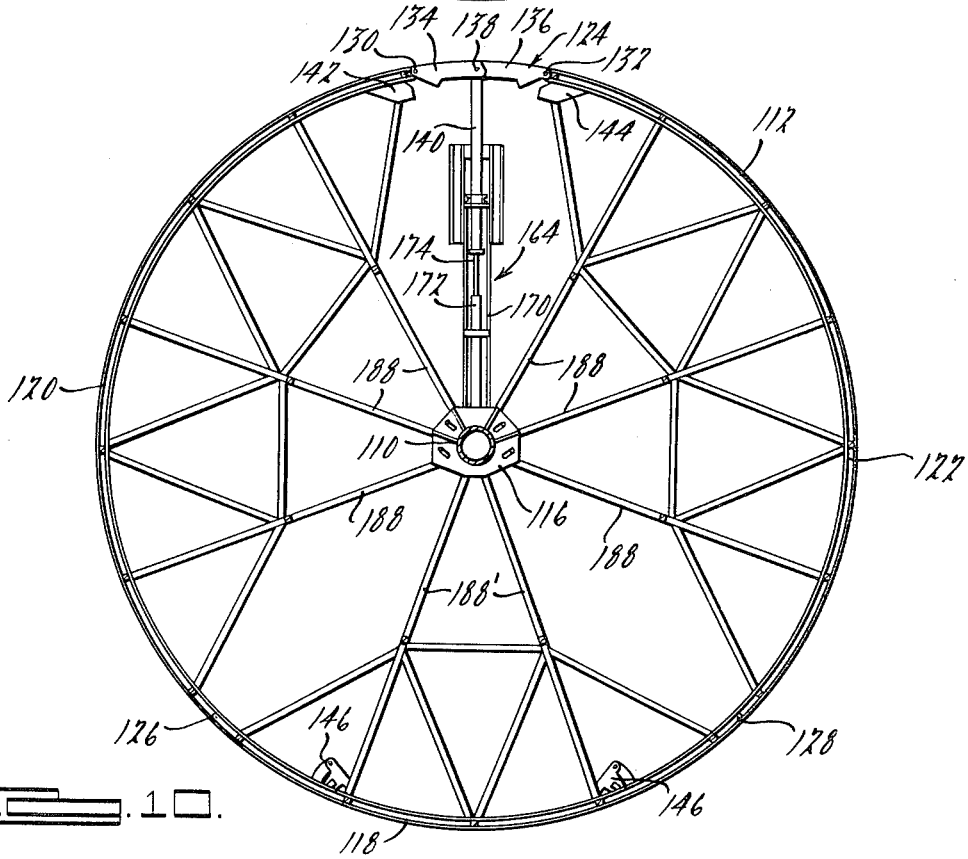
FIG. 10.

FIG. 26.
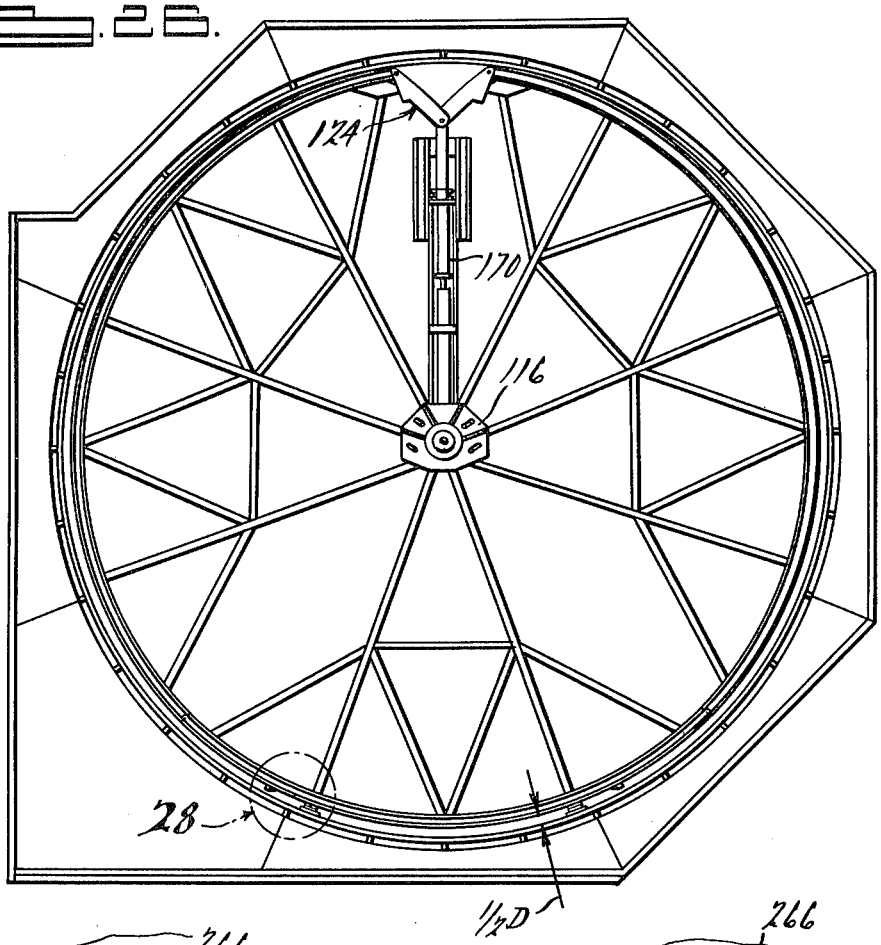
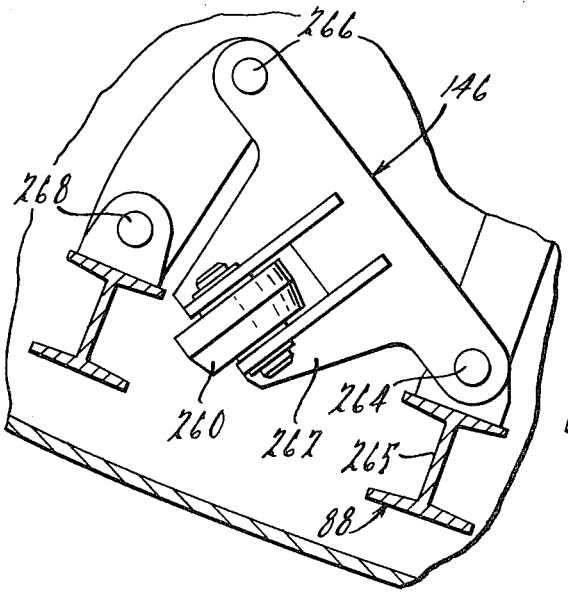
FIG. 27.
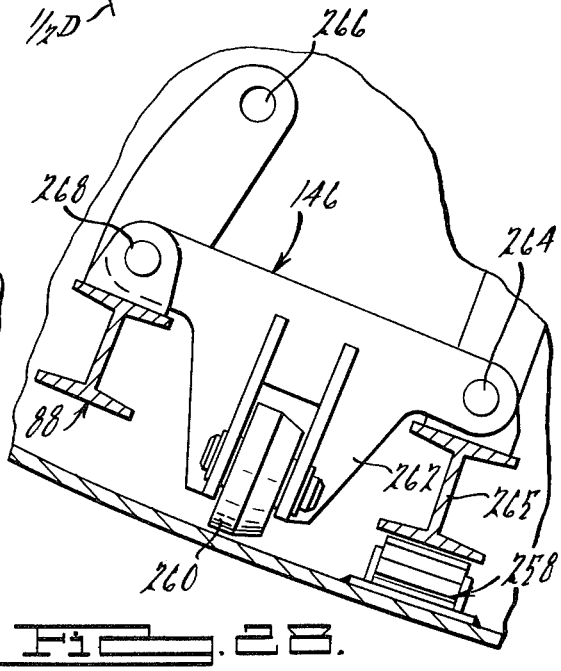
FIG. 28.

36

APPARATUS AND PROCESS FOR MANUFACTURE OF TUNNEL TUBES

This is a division of application Ser. No. 256,710, filed Apr. 23, 1981, now U.S. Pat. No. 4,418,561.

CROSS REFERENCE TO RELATED PATENTS

The subject matter of this application is related to the subject matter disclosed in application Ser. No. 256,729, entitled "Collapsible Fixture for Manufacture of Tunnel Tubes"; Ser. No. 256,728, entitled "Apparatus & Process for Improved Manufacture of Shells for Tunnel Tubes"; and Ser. No. 256,709, entitled "Access Tower for Manufacture of Tunnel Tubes", which were filed on the same day as this application and assigned to the same assignee.

BACKGROUND AND SUMMARY OF THE INVENTION

This invention relates to the construction of tunnel tubes for use under rivers, bays and other bodies of water, and more particularly to improved apparatus and process of manufacture of the component parts for such tunnel tubes. Then the tubes are positioned in open-trenches on the floors of the bodies of water, the tubes are assembled from individual sections which are fabricated on land and then floated to the tunnel site where they are lowered into place. Due to their enormous size, the tunnel sections are in turn constructed of a plurality of separate modules which are individually fabricated and then assembled together.

Tunnel tubes for vehicular highways or mass-transportation systems can be on the order of one-half mile to a mile or more in length. Typically, the tunnel sections used to make up the tunnel tubes are made of steel, can be 300 to 400 feet in length, 30 to 40 feet in diameter, for example, and thousands of tons in weight. The tunnel modules in turn are the same diameter as the sections, but are a fraction of their length and weight and are easier to assemble and handle. For example, a tunnel section can be comprised of five to ten tunnel modules or more, each module being 30 to 45 feet in length.

The tunnel tubes can have a single passageway or lane for traffic, or can have several lanes. Often two tunnel sections are intimately joined together side-by-side forming a tunnel tube with four lanes or more for traffic.

The individual tunnel modules are welded or otherwise securely fixed together at the construction site into an elongated tunnel section. Where a single tunnel section is utilized, the requisite number of modules are reinforced, positioned end-to-end, and then joined together as a unit. Where two tunnel sections are to be constructed as a tunnel unit, the modules are welded both end-to-end with other modules, as well as side-by-side with adjacent modules. An external framework of steel plates is positioned around the perimeter of the tunnel sections forming enclosed units. The open ends of the hollow tunnel sections are also covered with steel plates so that the sections can be floated and towed to their final positions. Either at the site where the tunnel sections are assembled, or at another site where the sections are first towed, the sections are completed internally with a concrete lining, roadways, fresh air passageways, wiring and the like. In this manner, once the tunnel sections are positioned in the trenches, most of the remaining work will involve connecting the internal structures and mechanisms together.

The construction methods and equipment used to position and lower the tunnel sections into the trench and then fasten them together underwater are known and do not form a part of this invention. A preferred method is disclosed in the article entitled "Deep-Water Tunneling Operations Tie-In with Pinpoint Accuracy", which appeared in the September, 1973 issue of "Construction Methods & Equipment", the disclosure of which is hereby incorporated by reference.

The trench is dredged and the bed is prepared while the tunnel sections are being constructed and towed into position. The tunnel sections are accurately positioned over the trench on the water surface by barges and tugboats and then weighted further with ballast and slowly lowered beneath the water into the trench. One end of each section has a large rubber gasket mounted around it and hydraulically operated jacks and locking devices are actuated to pull the sections together in the trench and securely lock them together. Since the tunnel sections are hollow and sealed, the only water which needs to be evacuated is contained in the areas between the sections. Once this is pumped out, the facing plates on the ends of the sections are removed and finishing work is done to connect the sections and complete the tunnel tube. When the tunnel sections are finally positioned and locked in place, they are covered over with fill as well as the material originally excavated from the trench.

The tunnel modules are formed from a large rectangular steel plate of about ¼ to 9/16 inch in thickness which is rolled into a large cylinder. A cylindrically-shaped fixture is used as a form around which the cylinder is rolled. The rolling fixture (also called a "spider") is collapsible so that it can be removed later from the module.

After the module shell is formed, the shell and fixture are placed as a unit on pedestals where a supporting and bracing framework is constructed around the external surface of the shell. The shell and fixture unit is adapted to be rotated so that the external framework can be secured to it in the easiest manner. An access tower is provided for workmen so they can more easily position and secure the framework components to the shell.

Once the braces, struts and other supporting framework are fixed to the shell, the module is complete except for the external skin or surface of steel plates. The plates can be added at this time before the fixture is collapsed and removed, or afterwards when the module is being secured to other modules.

When all the modules are welded together and the external plates and end plates are welded on them forming an integral tunnel section, the section is complete and ready to be launched. Access to the tunnel sections for any further internal work is accomplished through one or more holes cut in the top thereof.

Heretofore when tunnel modules have been constructed, some problems and difficulties have been encountered in the construction process. Some of these problems relate to the rolling up of the steel shell, the rotating of the shell and fixture on the pedestals, the collapsing of the rolling fixture, the removal of the fixture from the shell, and the reassembly of the fixture for reuse. Another problem area concerns workman access from the tower to the shell for assembly of the diaphragms and support framework.

It is an object of this invention to improve the apparatus and process for fabrication of tunnel modules. It is a further object to overcome one or more of the problems and difficulties heretofore encountered in the construction of tunnel modules and sections.

The above problems and difficulties are overcome by means of the apparatus and process described and claimed herein. The apparatus and process are further shown in the appended drawings which are described below.

BRIEF DESCRIPTION OF THE DRAWINGS

FIG. 1 illustrates a section of multi-lane vehicular tunnel tube which consists of a plurality of modules made in accordance with the present invention;

FIG. 2 is an exploded view of the tunnel section of FIG. 1 showing the individual modules;

FIG. 3 is a side view, partially in section, of one of the tunnel modules of FIGS. 1 and 2;

FIG. 4 is an end view of a tunnel module;

FIG. 9 is a cross-section of the fixture when viewed in the direction of arrows 9—9 of FIG. 8;

FIG. 10 is a cross-section of the fixture when viewed in the direction of the arrows 10—10 of FIG. 8;

FIG. 26 depicts the fixture after it is raised up within the tunnel module, the roller mechanisms have been positioned inside the shell, and the removal wheel members are lowered;

FIG. 27 illustrates the removal wheel members before they are lowered;

FIG. 28 is an enlarged view of the encircled area of FIG. 26 showing the removal wheel members in their lowered position; as well as the positioning of the roller mechanism inside the module shell;

DESCRIPTION OF THE PREFERRED EMBODIMENTS

Figure 5:
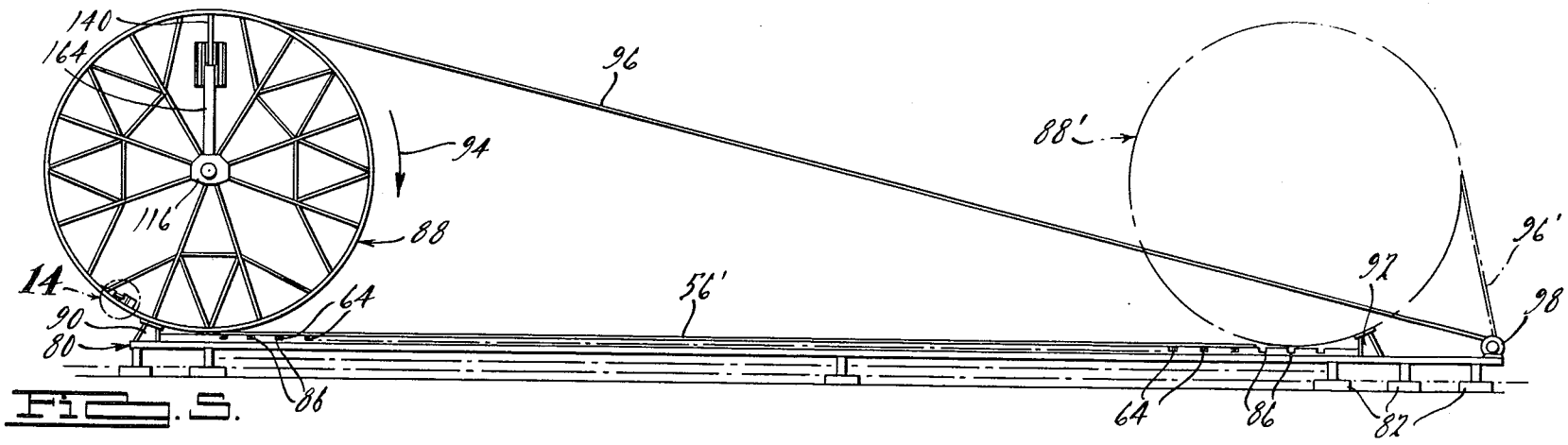
FIGS. 5 and 6 illustrate a side view and a top view, respectively, of the roll-up table fixture and roll-up procedure used to form the initial portions of a tunnel module.

A section of a tunnel tube for a multi-lane vehicle roadway is shown in FIG. 1 and generally designated by the reference numeral 50. An exploded view of the tunnel section 50 showing the individual tunnel modules 52 and 54 is shown in FIG. 2. The section 50 is formed in this instance of fourteen modules, ten modules 54 each approximately forty-five feet long and four modules 52 each approximately thirty feet long. Other combinations and sizes are of course possible. One of the individual tunnel modules 54 is shown in side and end views in FIGS. 3 and 4, respectively.

As shown in FIGS. 1–4, each of the tunnel modules and thus each of the tunnel sections has a cylindrical-shaped internal hollow shell 56. When the modules 52, 54 are connected end-to-end, an elongated tunnel 58 is formed. The shell 56 is surrounded on its external surface by a plurality of bulkheads or diaphragms 60 and supporting girders or struts 62. The outer surface of the shell 56 also has a plurality of stiffening members 64 which are secured to the plate prior to the time it is rolled up into a shell. The diaphragms 60 act to form a stabilizing framework around the shell to help strengthen it for its ultimate use and at the same time act together with struts 62 to form a supporting framework for the external plates 66. A plurality of plates 66 are secured as by welding around the entire outer surface of the tunnel modules and sections. Later, after the tunnel section is almost finished, some of the compartments formed between the shell 56 and the outer skin of plates 66 are filled with concrete or ballast. Eventually, when it is time to sink the tunnel sections and position them into the trench in the seabed, virtually all of these compartments are filled with concrete or other ballast.

The shell 56 and the plates 66 are formed of about ¼ to 9/16 inch thick steel plates. The diaphragms, supporting girders and stiffening members also are made of steel. The diaphragms are preferably formed into I-beams or T-shaped beams in cross-section, and the girders are either angle irons or metal box beams with a square-shaped cross-section. Also, all of the metal plates, girders, etc. are secured and permanently fastened together by welding. Of course, other materials with similar properties and performance are also believed to be usable.

Although the internal shell 56 is circular in cross-section, the outer surface formed of plates 66 is generally octagonal in cross-section. When two tunnel modules are to be positioned side-by-side as depicted in FIGS. 1–4, one side 68 of each module is adapted to abut a corresponding side of another module which is formed as a mirror-image of the first one. The side 68 and corresponding side of the adjacent module also do not have plates 66 positioned thereon, but are butt welded together facing each other as shown in FIGS. 1 and 2. The plates 66 welded to all of the remaining external surfaces of the two-part tunnel section 50 completely enclose the structure.

After the modules 52 and 54 are welded together into a completed tunnel tube section, the structures inside the tube or shell 56 are completed. A concrete liner 70 is formed around the entire inside diameter of the shell and a concrete roadway 72 is added. A ceiling surface 74 is formed above the roadway 72 and openings 76 and 78 are left for fresh air passageways, wiring, conduits, ducts and the like. Typically, the completion of the internal structures is done after the tunnel section is launched and floated, but before it is towed into position above the trench or lowered into it.

Figure 6:
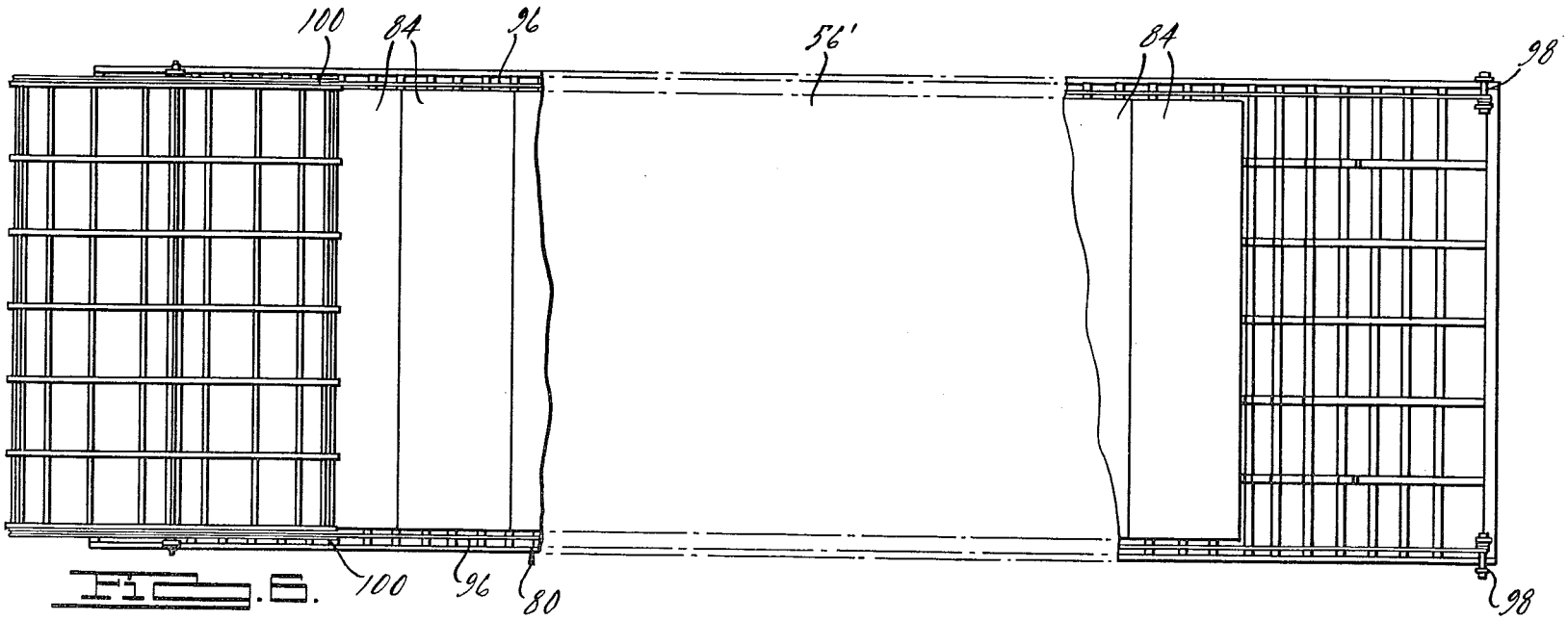

The apparatus and procedure used to construct the shell 56 is shown in FIGS. 5 and 6. The rectangular piece of steel 56' from which the shell is to be made is laid out flat on a roll-out table 80. The table 80 is constructed of I-beams and other steel components in a grid pattern essentially as shown and the table is positioned on concrete footings 82. The flat plate 56' is fabricated from numerous smaller plates 84 which are cut to size and butt welded together along their seams. The length and width of the plate 56' are predetermined and the plate 56' is cut to the size necessary to form the shell 56 of the module. A plurality of long, thin stiffening members 64 are welded to the plate 56' before it is laid on the table 80. (The stiffeners 64 are better shown in FIGS. 4, 16 and 22.) The stiffeners 64 are positioned on the bottom of the plate 56' when it is laid out on the roll-up table 80 so they will be on the outer surface of the shell 56 when it is rolled up. The stiffening members 64 fit within a plurality of spaced-apart slots 86 in the grid members on the table so that the plate 56' will lay flat.

The plate 56' is rolled up around a fixture 88. The fixture is also called a spider and is described in more detail below. The fixture 88 is placed on one end of the plate 56' on the roll-up table 80. Blocks 90 and 92 are provided on each end of the table 80 to limit the movement of the fixture and hold it steady at the beginning and conclusion of the roll-up process. The end of the plate 56' (the left end as shown in FIGS. 5 and 6) is secured to the fixture 88 using a plurality of U-shaped brackets (not shown) positioned over appropriate members of the fixture and welded to the surface of the plate 56'. Later, after the plate is completely rolled up and two opposite ends of the plate are butt welded together, the U-shaped brackets are knocked off.

During roll-up, the fixture 88 with the plate 56' attached is rolled in the direction of the arrow 94 from one end of the table 80 to the other. The position of the fixture 88 at the conclusion of the roll-up process is shown in phantom lines and designated by the numeral 88'. Steel wire cables 96 attached at one end to the fixture 88 and at the opposite end to winches 98 are used to roll the fixture along the table. Preferably the winches are hydraulically driven but can be electrically or pneumatically driven instead. A pair of cables and winches are provided, each pair associated with a U-shaped channel 100 extending in a circle around the outer edges of the fixture 88. (For a better understanding of the channels they are also shown in FIGS. 8, 11–14, 16 and 23.) Before the roll-up procedure is initiated, the cables 96 are wrapped at least once completely around the fixture (in the channels 100) and securely attached thereto. Preferably, the cables are wrapped 1½ times around the fixture channel, as shown in FIG. 5. In this manner, the cables do not have to be detached, repositioned and reattached at any point in the roll-up process, as was necessary with prior tunnel fabrication procedures, but the process can be continued from start to finish without any interruptions.

Figure 14:
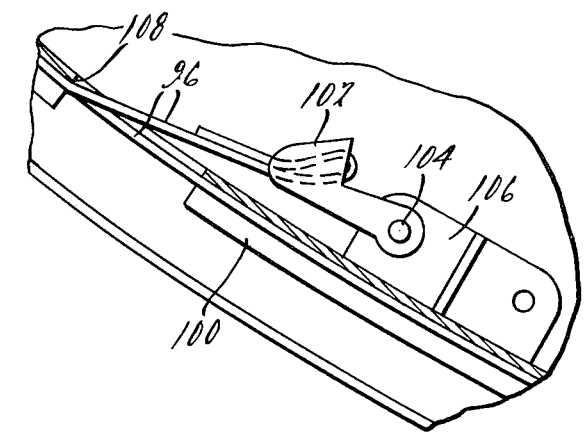
FIG. 14 is an enlarged view of the encircled area of FIG. 5 and depicts the manner in which the cable is attached to the fixture for roll-up.

FIG. 14 is an enlarged view depicting the manner in which the cables 96 are attached to the fixture 88. A wedge-cable anchor socket 102 is attached by pin 104 to a bracket 106 which is secured to and part of the fixture. The cable 96 after it is wrapped in the U-shaped channel 100 completely around the fixture is passed through a gap 108 in the channel 100 and secured to the lug 102.

Figure 15:
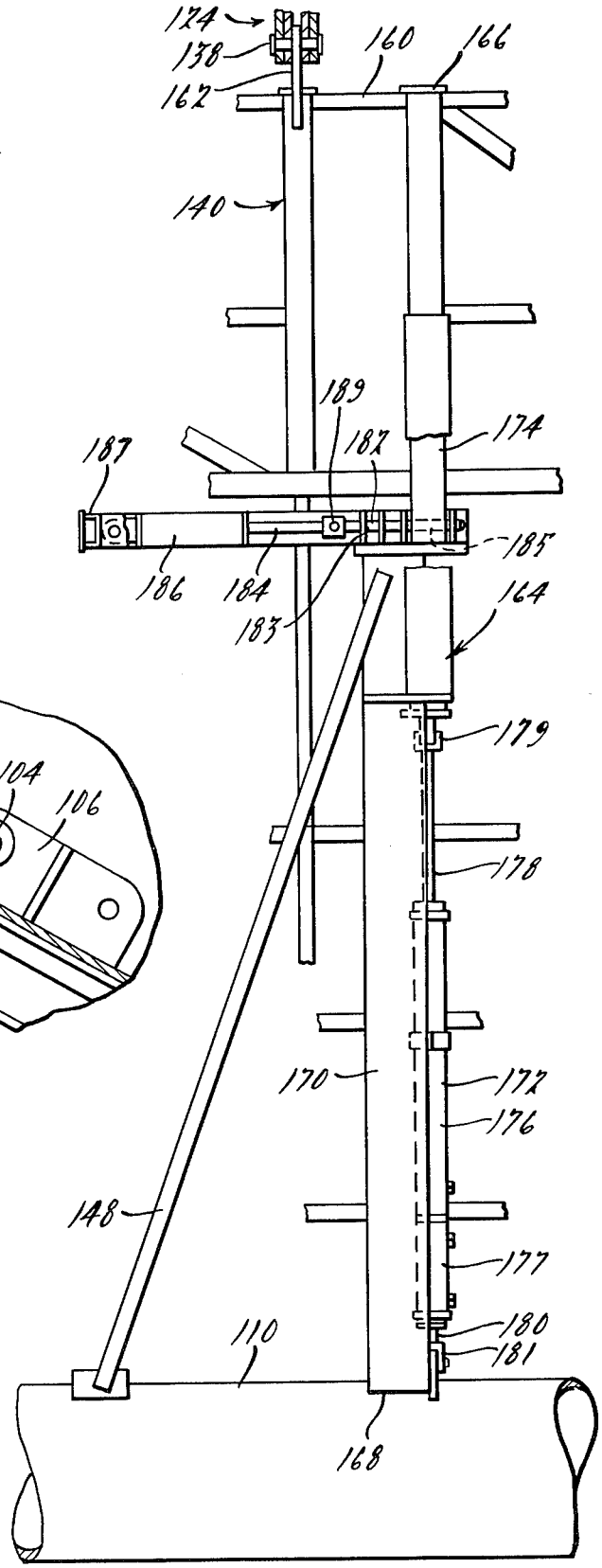
FIG. 15 is an enlarged view of one of the mechanisms used to collapse the fixture for removal from the tunnel module.

If the two ends of the plate 56' overlap when it is rolled up, the excess can be cut off and the two ends welded together, or the plate can be sprung open to allow the two ends to meet. If, on the other hand, a gap is left between the ends of the plate when it is rolled up, means must be provided in order to compensate for it. In accordance with the present apparatus and process, a mechanism is provided in the fixture for slightly adjusting the diameter of the fixture to compensate for such an occurrence. This mechanism is discussed below in connection with the discussion of FIG. 15.

Figure 7:
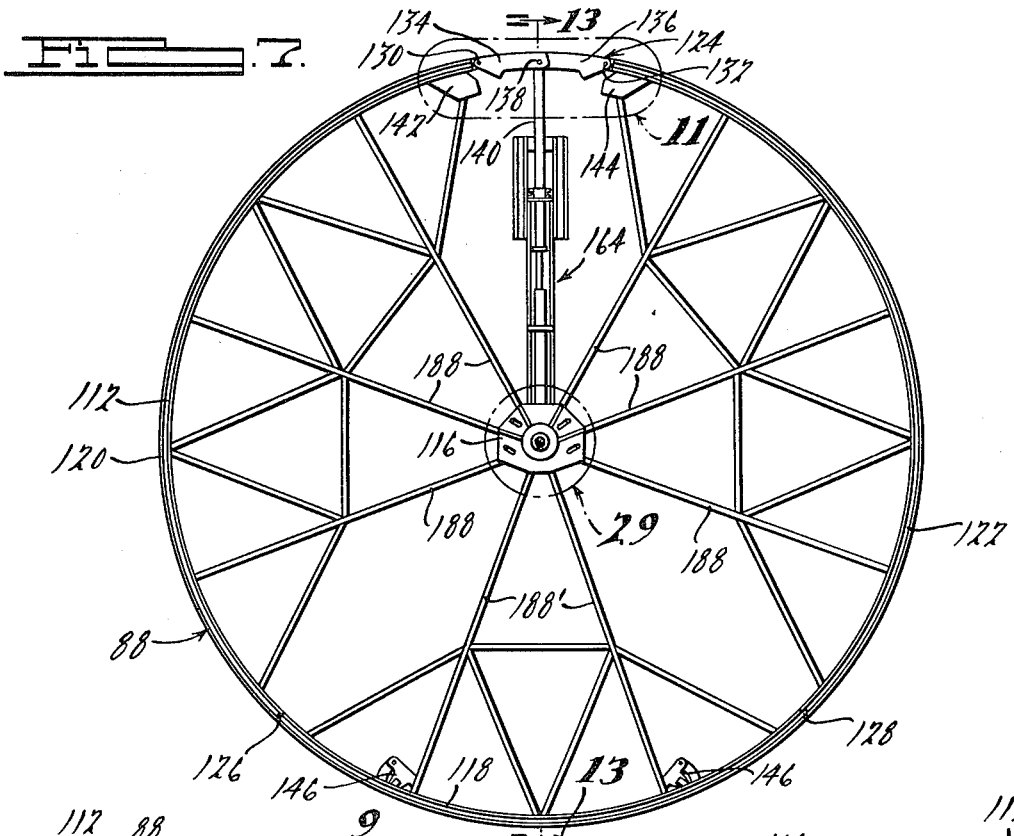
FIG. 7 is an end view of the fixture used to form a tunnel module.
Figure 13:
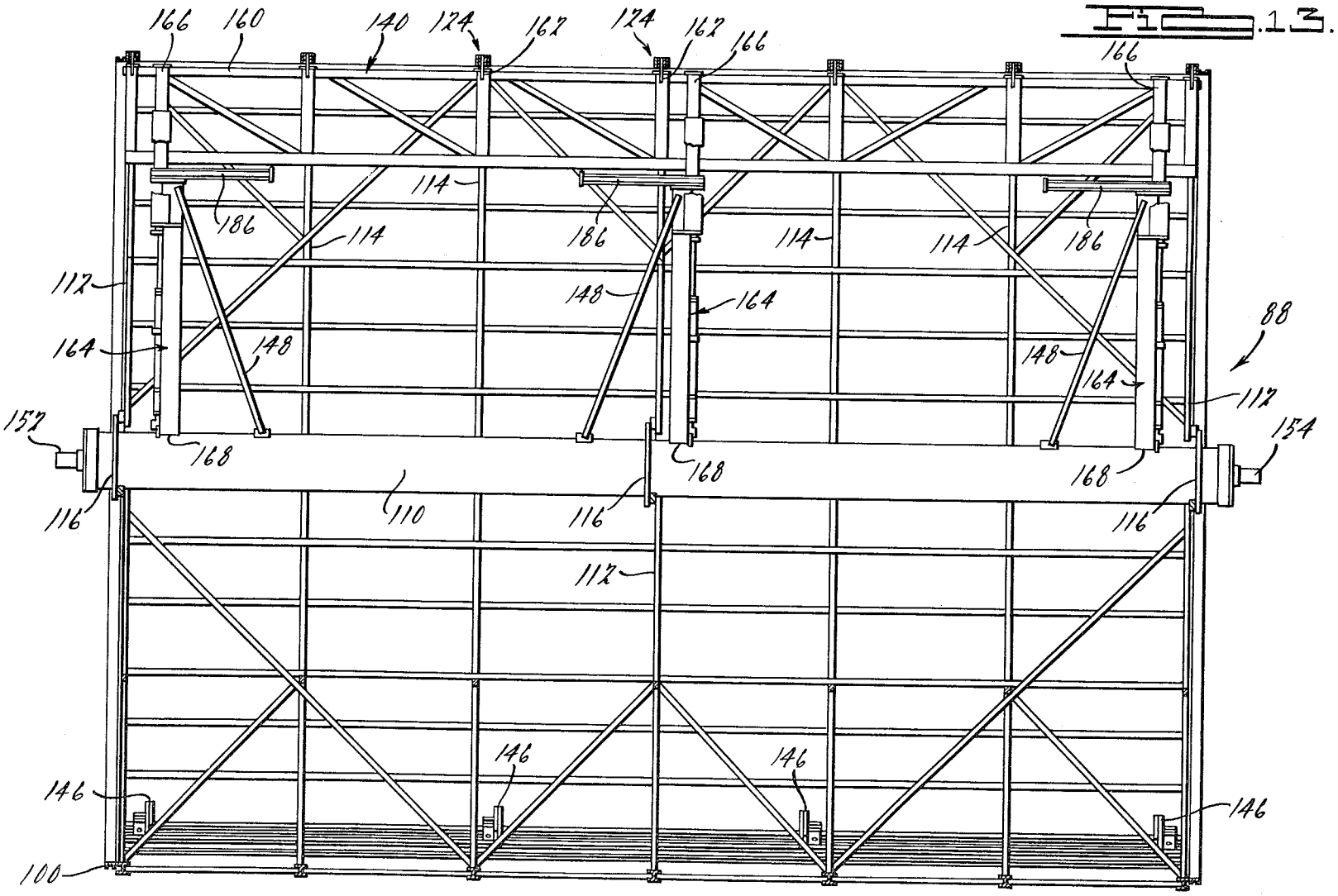
FIG. 13 is a length-wise cross-section of the fixture of FIGS. 7 and 8 when viewed in the direction of arrows 13—13 of FIG. 7.

The details of the fixture 88 are shown in FIGS. 7–13. An end view of the fixture is illustrated in FIG. 7 and a side view in FIG. 8. FIGS. 9, 10 and 13 depict cross-sectional views taken along lines 9—9, 10—10 and 13—13 respectively of FIGS. 7 and 8 and are viewed in the direction on the arrows.

Figure 8:
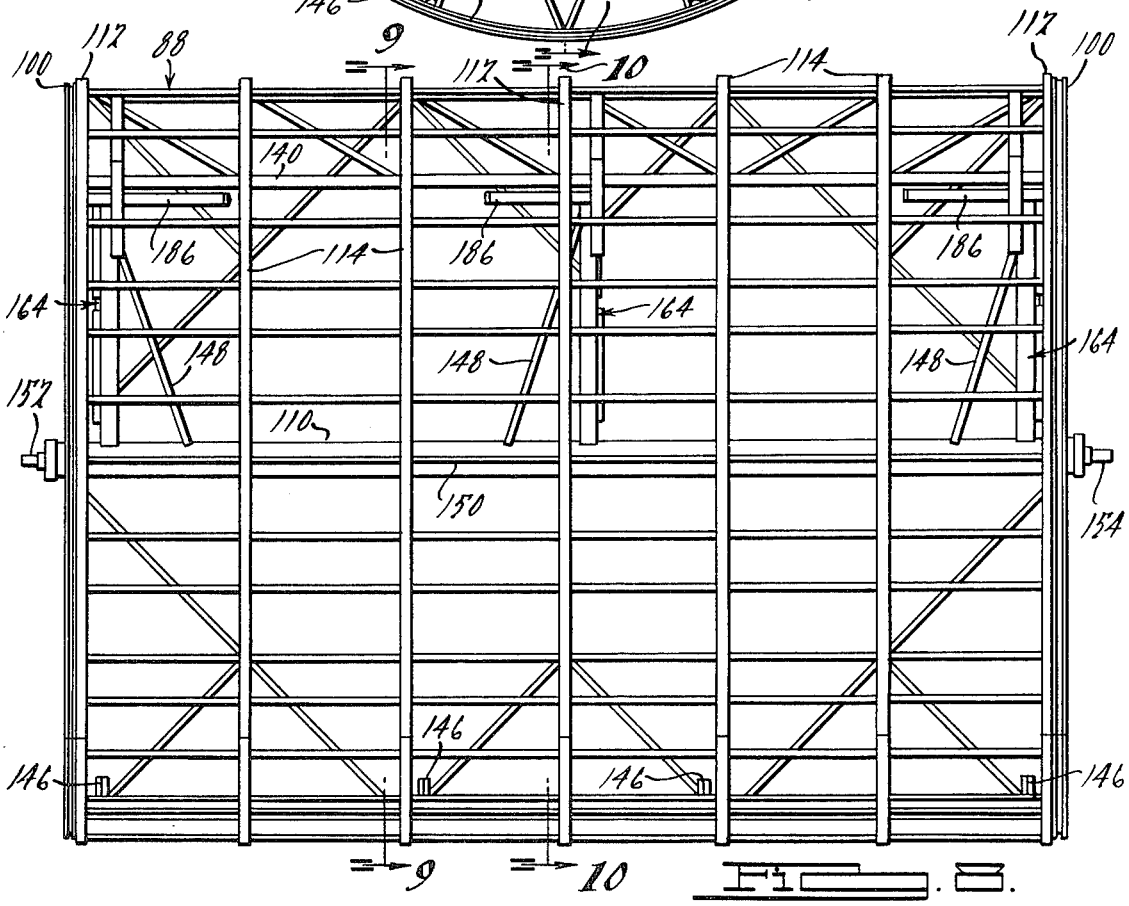
FIG. 8 is a side view of the fixture.

The fixture 88 has a central axle 110 and a plurality of circular main support members 112 and 114 (resembling spoked "wheels"). Three complete wheels 112 are provided (two or more are believed necessary) which have a complete framework of girders and I-beams, including some girders 188 and 188' extending inwardly to the axle 110. The girders 188 and 188' are attached to enlarged hug plates 116 which in turn are secured directly to the axle. The remaining circular members 114 are incomplete in the sense that they do not have any structural members connected directly to the central axle (see FIG. 9). The members 114 are connected to the other circular members 112 by means of the supporting framework of braces, I-beams and the like, as shown in FIGS. 8 and 13.

As mentioned earlier, the fixture 88 is adapted to be collapsed in order for it to be withdrawn from the completed or semi-completed module. Essentially, each of the circular support members 112 and 114 consists of four parts which allow the diameter of the fixture to be reduced sufficiently for removal. As shown in FIGS. 7, 9 and 10, the members 112 and 114 have a stationary base portion 118, two inwardly rotating side portions 120 and 122, and a folding top linkage portion 124. The two side portions 120 and 122 are pivotably connected to the base portion 118 by hinges 126 and 128 respectively. The top linkage portion 124 in turn is pivotably connected to the two side portions 120 and 122 by hinges 130 and 132, respectively. The linkage 124 is comprised of two foldable portions 134 and 136 which are pivotably connected together in the center by hinge pin 138. (The linkage arrangement is shown in more detail in enlarged form in FIGS. 11 and 12.)

The center pin connection 138 between the two parts of the foldable linkage is directly attached to a jacking truss 140. The truss 140 extends the axial length of the fixture 88 and operates all of the foldable linkages on all of the wheels 112 and 114 at the same time and in the same manner. In this regard, the operation of the jacking truss and thus the collapse and reassembly of the fixture is described in more detail below.

In general, when the jacking truss is lowered (i.e. pulled downwardly in FIG. 7 in a manner to be described hereinafter), the linkage 124 will fold inwardly causing the side portions 120 and 122 to rotate inwardly around pivot hinges 126 and 128. Stop members 142 and 144 limit the amount of movement of the linkage 124 and thus control the amount of collapse of the fixture.

A series of wheel members 146 are positioned along the length of the fixture and aid in the removal of the fixture from the module (as explained later). As shown in FIGS. 7 and 8, two rows of four wheel members 146 are provided. When the shell 56 is being rolled up and the module is being constructed, the wheels are in their "up" position (as better shown in FIG. 27). Later, when the fixture is being removed from the module, the wheel members are lowered into their operating positions. It is understood that the wheel members 146 are not shown in scale in relation to the other parts of the fixture 88 in FIGS. 7–10 and 13, but have been enlarged for ease of presentation and clarity.

The circular support members 112 and 114 and the various cross-braces, angular connecting and axial connecting members of the fixture 88 are comprised of I-beams, girders, box beams and other steel structural members arranged as shown in the drawings. It is not believed necessary to specifically identify and describe each of such members. Persons of ordinary skill in the art have sufficient information from the drawings together with this written description in order to duplicate and construct a similar fixture. It is also possible to build into the inside of the fixture various walkways, additional supports, ladders and the like if they are needed depending on the frequent use and specific application of the fixture. For example, three ladders 148 and a walkway 150 for access by workmen to the jacking truss operating system are included in the fixture shown in FIG. 8.

The ends 152 and 154 of the axle 110 extend outwardly beyond the supporting framework of the fixture 88. The ends 152 and 154 are circular shafts and are adapted to rotatably mate with cradle-type sockets at the top of pedestals 156 and 158 (FIGS. 16–18 and 21) when the fixture and shell unit is removed from the roll-up table 80 and subjected to further processing. The axle 110 and ends 152 and 154 act as a shaft to allow the fixture and shell to be rotated as a unit on the pedestals for assembly of bulkheads or diaphragms, girders and the like on the outer surface thereof.

The jacking truss 140 is best shown in FIG. 13. The truss 140 is made from a series of I-beams, box beams and other girders in the configuration shown. The truss 140 extends the entire axial length of the fixture 88 and acts like a rigid beam for collapsing and reassembling all parts of the fixture simultaneously and in the same manner. The top beam 160 of the truss 140 is attached by connecting members 162 to each of the foldable linkage mechanisms 124 of the circular support members ("wheels") 112 and 114.

The operating mechanisms 164 for the jacking truss 140 are attached at one end 166 to the truss itself and connected at the other end 168 to the central axle 110. Three identical operating mechanisms 164 are provided (two or more are believed necessary) in the fixture 88 and one of them is illustrated in enlarged detail in FIG. 15. The mechanism 164 generally comprises a structural support 170, a dual action hydraulic cylinder 172, and, sliding member 174. The support 170 is comprised of several girders and I-beams and provides the necessary rigidity and support for the cylinder 172 and sliding member 174. The cylinder 172 is preferably hydraulically operated but could be pneumatically operated instead. The cylinder 172 is a two stroke mechanism with two actuation chambers 176 and 177, a long stroke piston 178 and a short stroke piston 180. The long stroke piston 178 is attached by connecting mechanism 179 to sliding member 174 which in turn is directly connected to the jacking truss 140. The short stroke piston is attached directly to axle 110 by connecting member 181.

Figure 11:
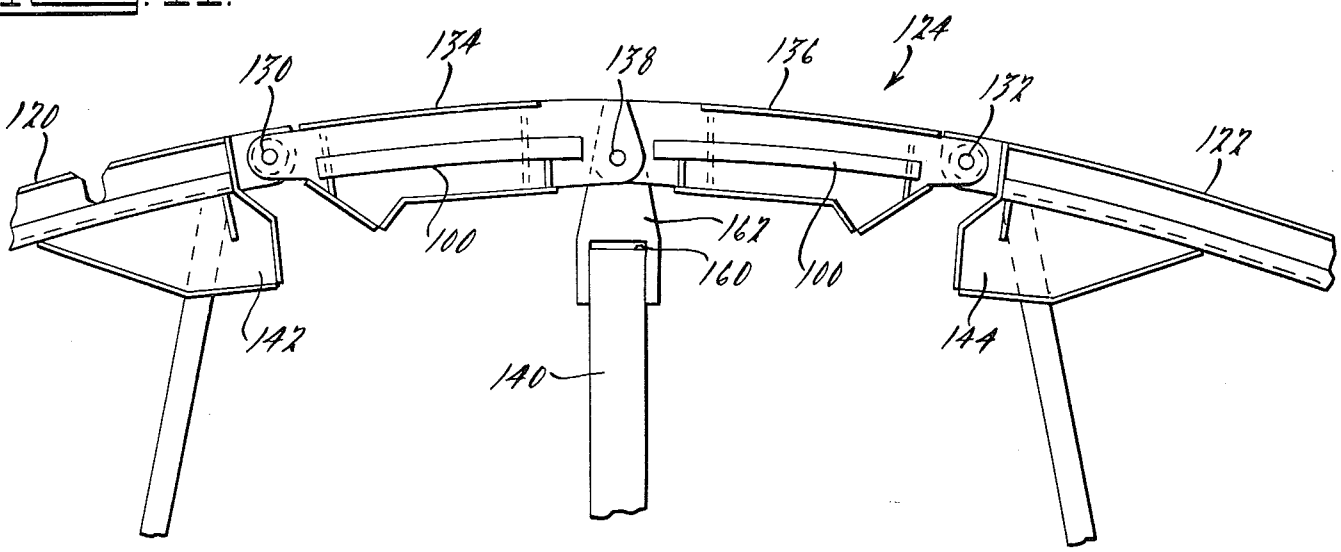
FIG. 11 is an enlarged view of the encircled area of FIG. 7, showing the collapsible mechanism of the fixture.
Figure 12:
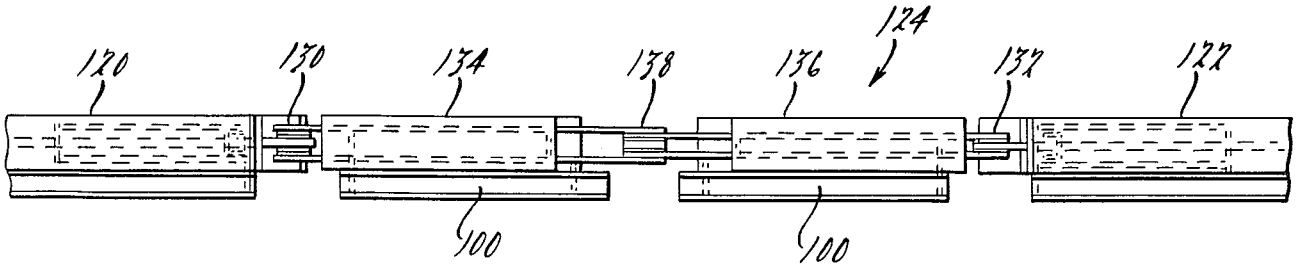
FIG. 12 is a top view of the mechanism of FIG. 11.

When the foldable linkage 124 is in its normal unfolded position (as shown in FIG. 11) and the fixture 88 has full cylindrical-shape, the long and short stroke pistons 178 and 180 are in their fully extended positions. In order to prevent the weight and the forces applied to the fixture 88 during roll up and subsequent processing steps from prematurely collapsing the fixture, a pin 182 is positioned in mating holes 183 and 185 through the structural support 170 and sliding member 174.

The pin 182 is attached by connecting mechanism 189 to piston arm 184 of another hydraulic cylinder 186. The cylinder 186 is positioned perpendicular to the hydraulic cylinder 172 and is attached to and supported by a beam 187.

Figure 24:
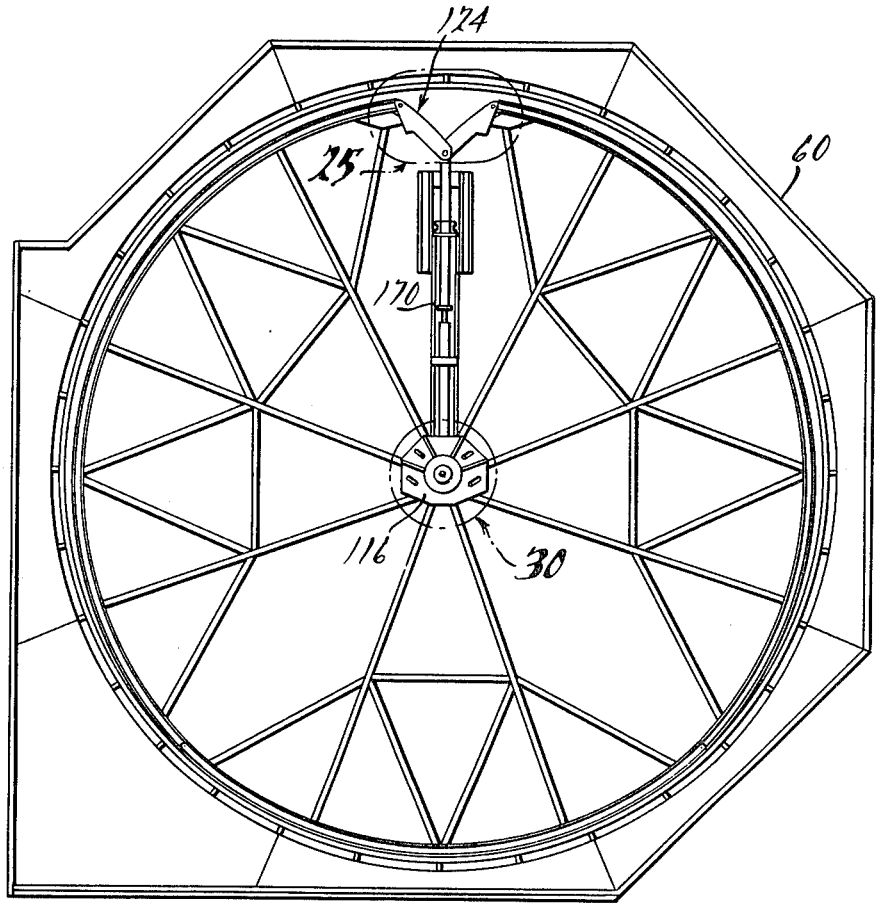
FIG. 24 is an end view of a tunnel module with the fixture collapsed for removal.
Figure 25:
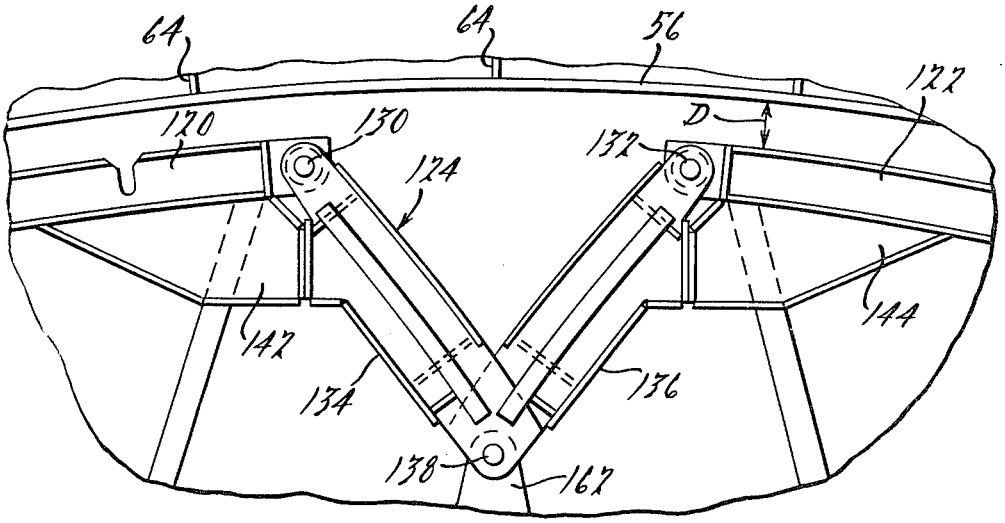
FIG. 25 is an enlarged view of the encircled area of FIG. 24 showing the foldable mechanism after it is collapsed.

When it is necessary to collapse the fixture 88 for removal from the module shell 56, the cylinder 186 is activated withdrawing the pin 182 from the sliding member 174. Then, the two cylinders 176 and 177 are activated and the jacking truss 140 is pulled inwardly toward the central axis of the fixture. This in turn causes the foldable linkage 124 to fold, the side portions 120 and 122 of the fixture to rotate inwardly, and the fixture to "collapse". The latter steps are shown in FIGS. 24 and 25. In this manner, a clearance "D" (FIG. 25) of from 8 to 10 inches can be obtained where the fixture has a diameter of from 30 to 40 feet.

Figure 29:
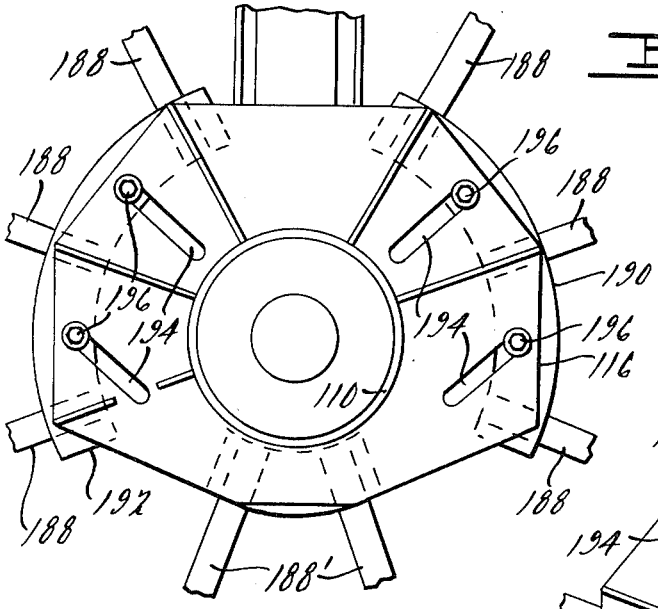
FIG. 29 shows the hub of one of the fixture sections before collapse, and also is an enlarged view of the encircled area of FIG. 7.
Figure 30:
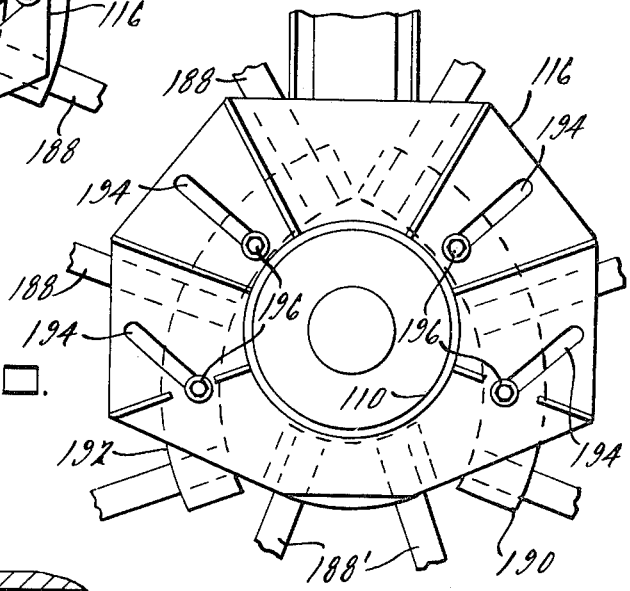
FIG. 30 shows the hub of one of the fixture sections after collapse, and also is an enlarged view of the encircled area of FIG. 24.

Before the fixture 88 can be collapsed, it is also necessary to allow the inner ends of the beams 188 extending to the center of the circular support wheels 112 to have some freedom of movement. This movement is provided and is accomplished by the bolt and slot mechanisms shown in FIGS. 7, 29 and 30 which are formed as part of the hub plates 116. In the circular support members 112, the plates 116 are welded directly to the center axle 110 and the beams 188 which extend inwardly from the movable side portions 120 and 122 are attached (welded) to arc-shaped members 190 and 192. Since the two lowermost beams 188' which also extend to the center of member 112 are connected at their outer ends to the stationary base 118 they do not need a similar freedom or availability of movement.

A series of slots 194 (four are shown) are provided in the plates 116. The bolts 196 extend through such slots and are threadably connected to nuts (not shown) on the opposite side of the arc-shaped members 190 and 192. When the fixture 88 is in its normal non-collapsed position, the bolts 196 and nuts are tightened and the arc-shaped members are in the positions shown in FIG. 29. When it is necessary to collapse the fixture, the bolts and nuts are loosened. In this manner, the arc-shaped members 190 and 192 will assume the positions shown in FIG. 30 when the cylinders 177 and 177 are activated and the linkage mechanism 124 is folded.

The dual action or two-stroke cylinder 172 also serves another purpose. If the steel plate 56' on the roll-up table 80 is cut slightly too small or a small gap exists for any other reason between the ends of the plate when it is rolled up into a cylindrical shell, then the short stroke piston 180 and its corresponding cylinder 177 can be activated. This will reduce the overall diameter of the fixture 88 to the slight extent necessary to close the gap and allow the ends of the plate 56' to be welded together. When the cylinder 177 is activated in this manner, it is not necessary to loosen the bolts 196, although it is necessary to remove the pins 182 from the operating mechanisms 164. There is sufficient clearance and elastic flexibility in the parts of the fixture which will allow the diameter of the fixture to be reduced slightly without loosening the bolts on the hub plates 116.

Figure 16:
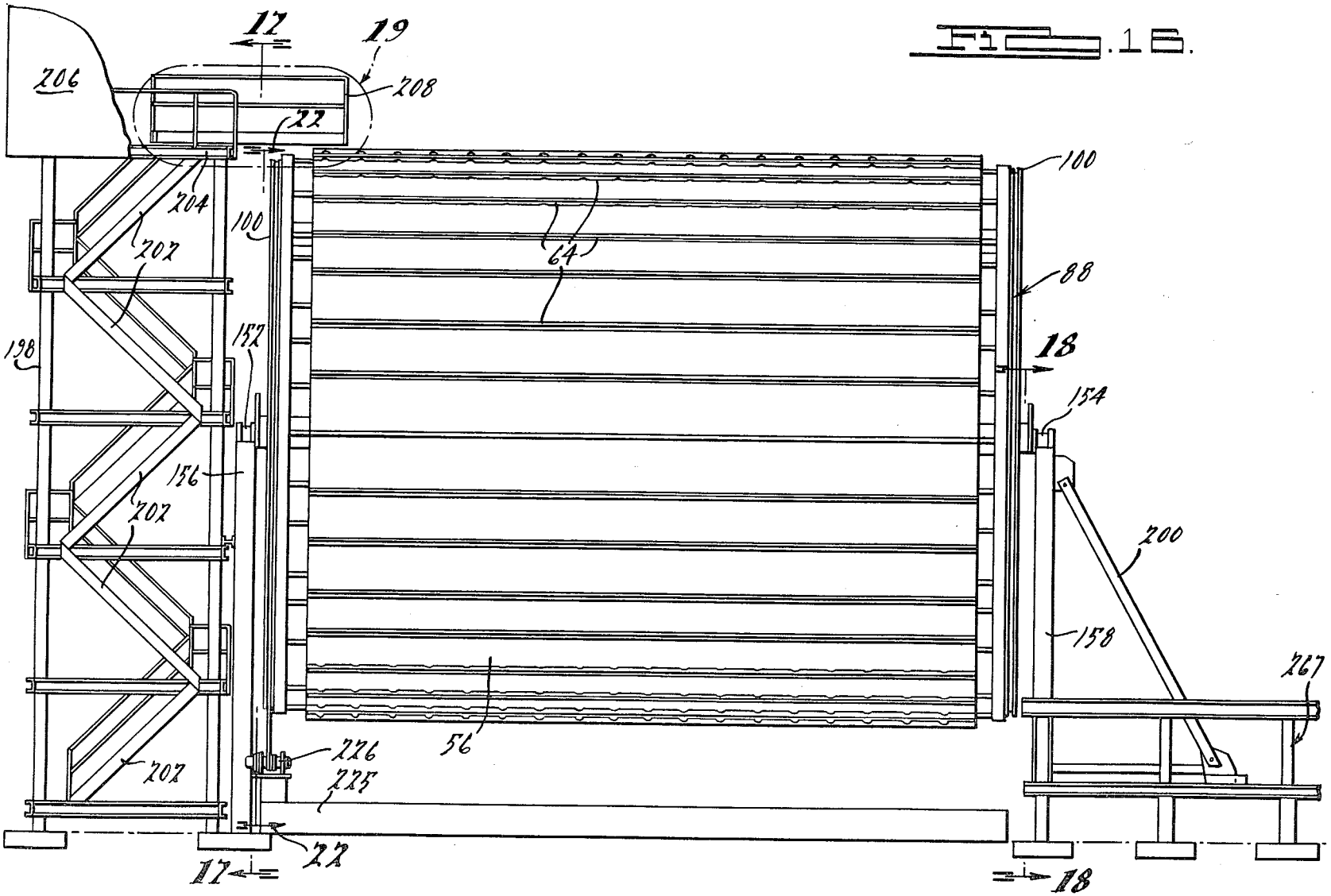
FIG. 16 is a side view of the fixture after the module shell has been rolled up and the fixture and shell unit has been positioned on the pedestals for further processing.

After the shell 56 has been rolled up on the spider 88, the shell and fixture is moved as a unit onto pedestals 156 and 158. This is shown in FIG. 16. A tower 198 is positioned at one end of the pedestals to allow workmen to have ready access to the shell for further processing.

The pedestals 156 and 158 are A-frame type structures (see FIGS. 17 and 18) made of steel beams and other structural components. Pedestal 156 is positioned adjacent to and supported by the access tower 198, while pedestal 158 has a rear brace 200 for support. Pedestal 156 is permanently installed in the position shown, while the other pedestal 158 is adapted to be removable. As explained later, pedestal 158 must be removed in order for the fixture 88 to be pulled out and removed from the tunnel module.

The tops of each pedestal 156 and 158 have hydraulically operated jacking beams 240 and 242, respectively installed in them. (See FIGS. 17, 18 and 21.) These beams 240 and 242 comprise slidable steel frameworks 244 and 246 which are attached to the piston arms of hydraulic cylinders 248 and 250 and supporting cradles 252 and 254. The frameworks 244 and 246 are slidably arranged in the tops of pedestals 156 and 158 and the cradles support the shafts 152 and 154 of the axle 110. When the cylinders 248 and 250 are actuated, the fixture 88, together with the shell 56 (or completed module), can be raised or lowered.

The access tower 198 has sufficient height to allow workmen to have access directly to the top of the shell 56. Due to the weight and structural configuration of the diaphragms and supporting framework members, as well as the manner in which they are positioned on the shell, it is easier to assemble them on the top surface of the shell. In order to facilitate easy assembly of these members on the shell and always on the top surface, the shell and fixture unit is rotated on its pedestal supports.

Figure 17:
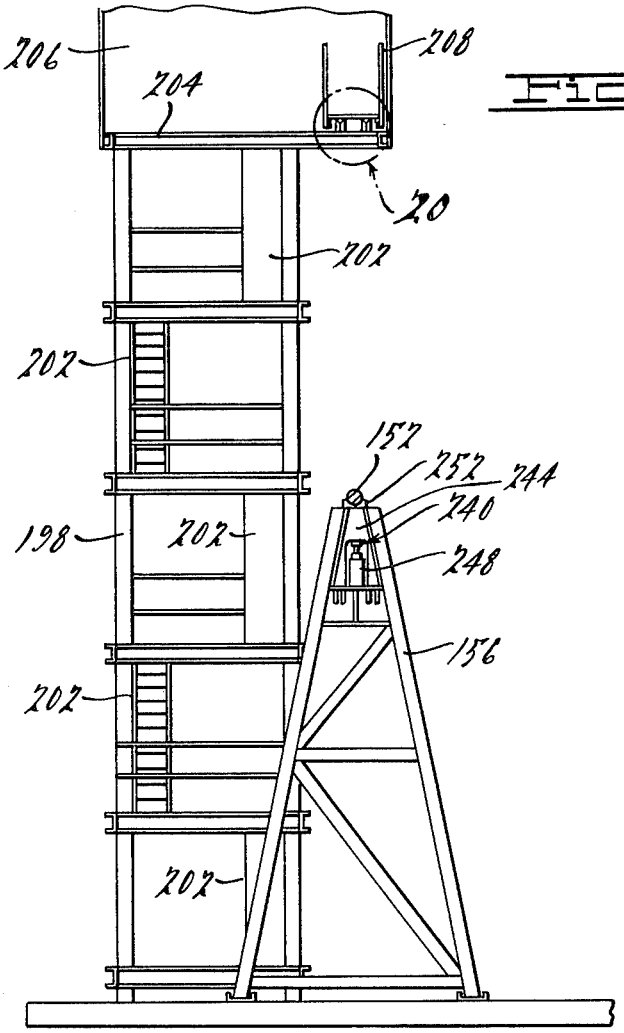
FIG. 17 is a cross-sectional view taken in the direction of arrows 17—17 of FIG. 16 and showing one of the pedestals and the access tower.
Figure 18:
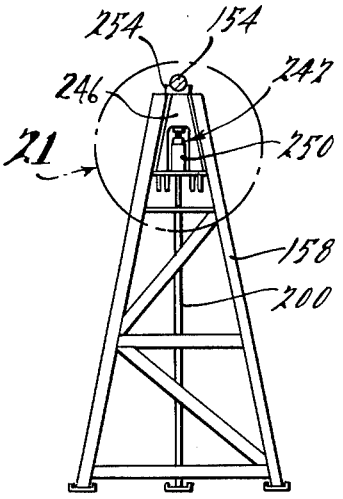
FIG. 18 is a cross-sectional view taken in the direction of arrows 18—18 of FIG. 16 and showing the other pedestal.

The tower 198 has a steel I-beam framework and a series of ladders or stairways 202 leading from the ground to the upper platform 204 as shown in FIGS. 16 and 17. A house or booth 206 is positioned on top of the tower to protect the workmen from adverse weather elements. A moveable bridge 208 is positioned in the booth 206 and on top of the platform 204. After the shell and fixture unit is positioned on the pedestals 156 and 158, the bridge 208 is rolled out and extended over the surface of the shell so that the workmen can have access to the top of the shell. Also, as indicated earlier, the tunnel modules sometimes have varying lengths (30 to 45 feet), but, since they all have the same diameter and are constructed in essentially the same manner, they are all made on the same fixtures 88. Thus, the moveable bridge 208 is adapted to extend far beyond the edge of the fixture 88 in order to allow workmen access to shells which are much smaller in length than the fixture.

Figure 19:
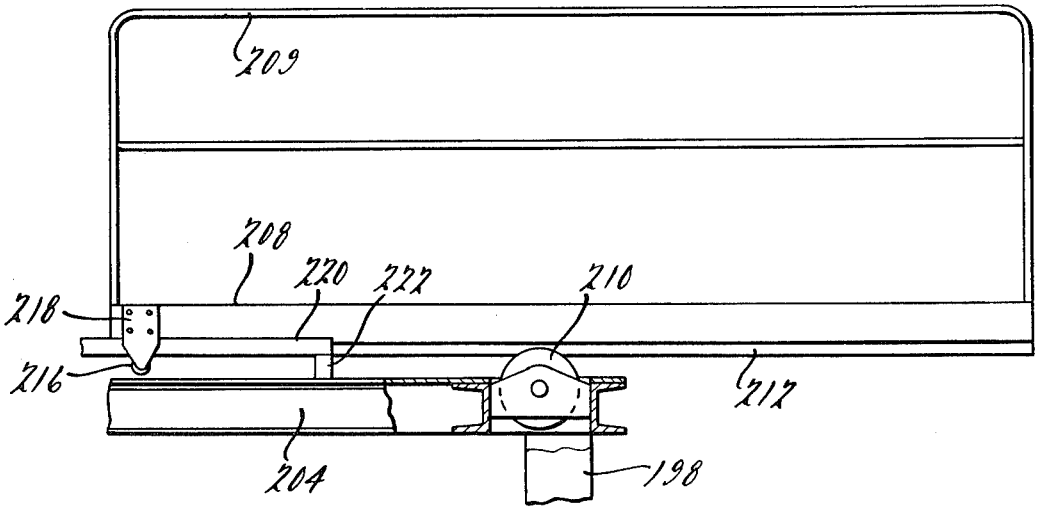
FIG. 19 is an enlarged view of the encircled area of FIG. 16 showing a side view of the moveable bridge.
Figure 21:
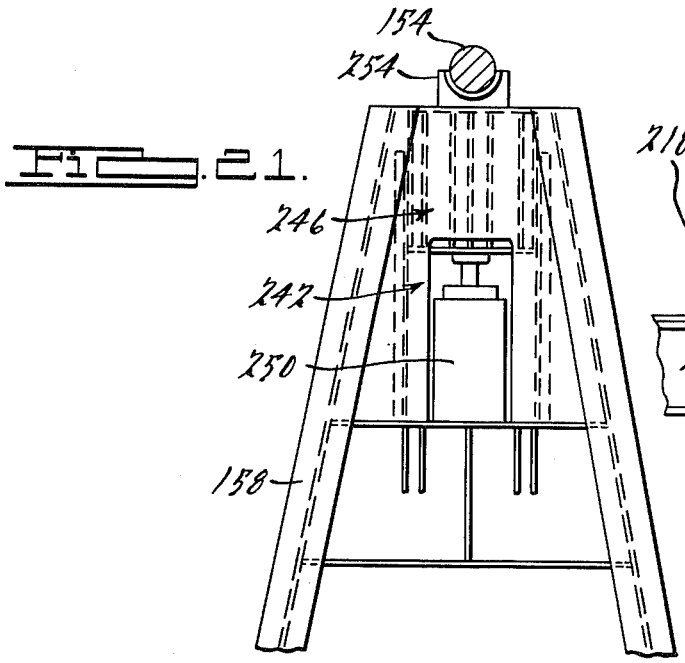
FIG. 21 is an enlarged view of the encircled area of FIG. 18 showing the adjustable top of a pedestal.
Figure 20:
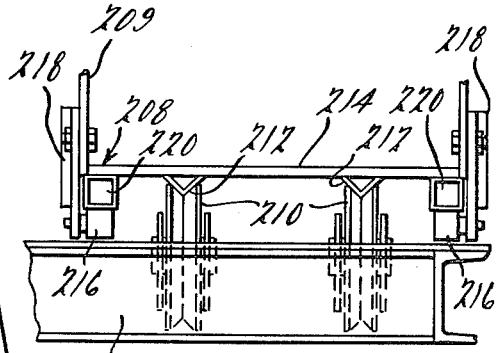
FIG. 20 is an enlarged view of the encircled area of FIG. 17 showing the end view of the moveable bridge.

Further details of the bridge 208 are shown in FIGS. 19 and 20. Handrails 209 are included on the sides of the bridge. A pair of V-rollers 210 are installed in the floor of the platform 204 and mate with bridge members 212 positioned underneath the floor 214 of the bridge 208. In addition, a pair of small rollers 216 are attached to the rear of the bridge by appropriate supporting members 218. These small rollers 216 guide along the underside of a supporting frame 229 attached to the platform 204 and prevent the bridge from tipping when a workman is on the outer end thereof. The frame 220 also has a stop 222 which prevents the bridge from rolling too far off the tower.

Figure 22:
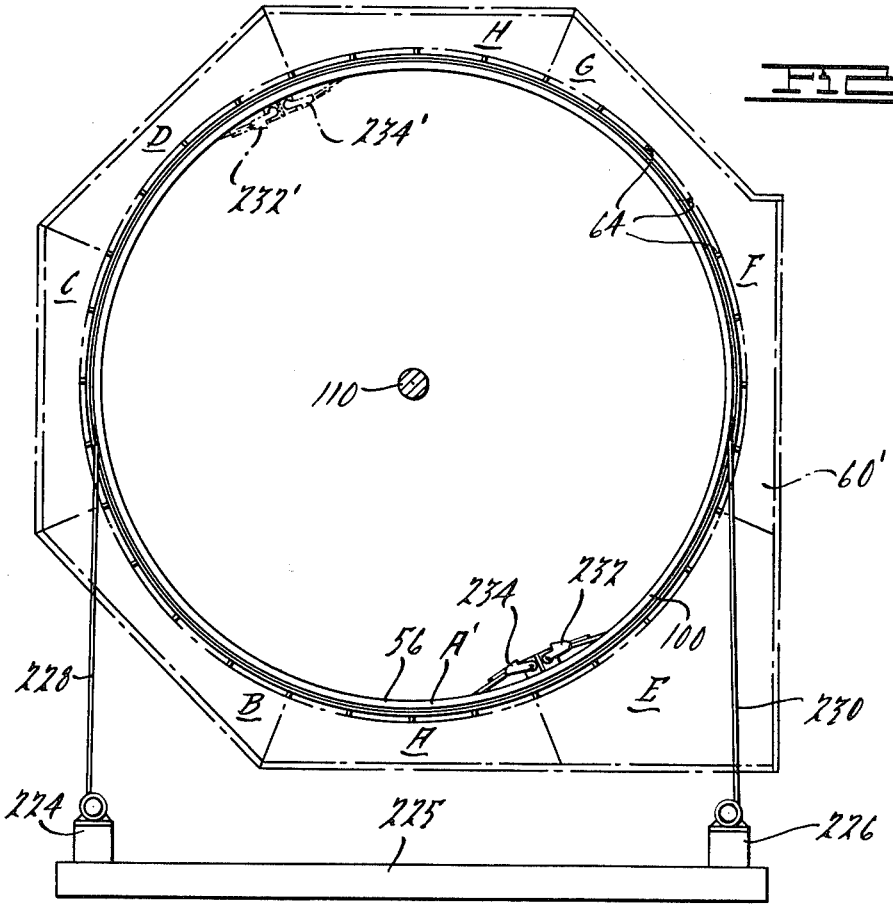
FIG. 22 is a cross-sectional view taken in the direction of arrows 22—22 of FIG. 16 showing the mechanism for rotating the fixture on the pedestals.

The arrangement for rotating the fixture and shell unit on the pedestals is shown in FIG. 22 in conjunction with FIG. 16. A pair of winches 224 and 226 are positioned on the ground or other supporting surface 225 at one end of the fixture 88 and approximately on opposite sides of a cross-section thereof. Cables 228 and 230 from winches 224 and 226, respectively, are positioned in one of the U-shaped channels 100 used earlier to roll up the shell. The cables 228 and 230 which are $\frac{5}{8}$ inch diameter wire cables, are wrapped prespecified distances around the circular channels 100, passed through appropriate gaps in the channel, and attached with wedge-socket cable anchor lugs 232 and 234 (in the same manner as that discussed above with reference to FIG. 14). Cable size is of course determined by the load. The winches 224 and 226 can be either electrically, hydraulically or pneumatically operated and preferably are similar in type, size and operation to the winches 98 used on the shell roll-up table 80.

The cable 228 is passed from winch 224, wrapped approximately three-quarters of the way around the perimeter of the fixture channel 100 (as predetermined for this construction), and connected to anchor lug 232 at the position shown in FIG. 22. Similarly, the cable 230 is passed from winch 226, wrapped approximately one whole turn around the fixture channel, and connected to anchor lug 234.

When the diaphragms 60 are assembled and installed on the shell 56, the portions comprising each diaphragm ring (eight are shown) are installed separately or may be installed as combinations of several adjoining portions. As indicated above, the diaphragm portions and other supporting framework members (such as members 62 shown in FIG. 3) are installed on the shell from the top position, although the other supporting framework members may also be installed from the bottom. To accomplish this, the winches 224 and 226 are operated and the shell and fixture unit is rotated on the pedestals 156 and 158 so that the appropriate surface of the shell is presented at the top position.

To install the diaphragm 60' as shown in phantom lines in FIG. 22, the first diaphragm portion to be assembled is portion A. At that point, the portion A' of the shell 56 is adjacent portion A will be at the top position. The shell and fixture unit is then rotated at 45° intervals counterclockwise and diaphragm portions B, C and D are welded in place. Then, the unit is rotated 180° clockwise and diaphragm portions E, F and G are installed. Finally, the unit is rotated another 45° in a clockwise direction and portion H is welded in place. At this point, the anchor lugs will be at the positions 232' and 234' (shown in phantom lines). Due to weight and balance considerations, the number of rows of diaphragms that may be installed at the same time may vary. If less than a complete set of diaphragm rings 60 and other adjacent support members are assembled in place initially, the process is repeated over and over until all of the requisite rings are in place. At this point, the module is essentially completed and the module will resemble the one shown in FIG. 23.

Figure 23:
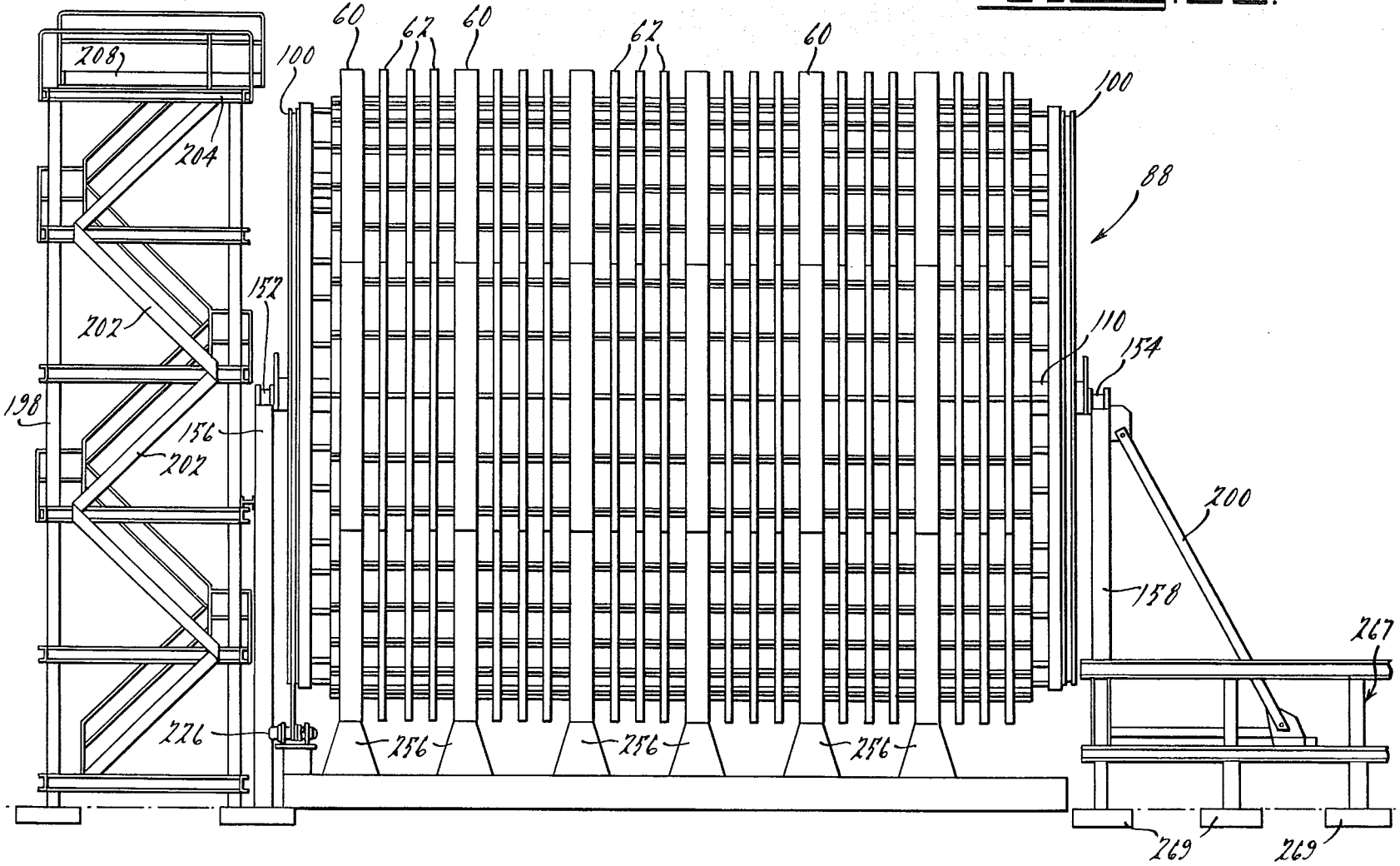
FIG. 23 is a side view of the module after further processing and when lowered onto supports.

After the module is complete, the spider or fixture 88 must be removed so that the module can be transported to the site where the tunnel section is being assembled and the exterior plates 66 are added on. To accomplish this, the jacking beam mechanisms on the pedestals 156 and 158 are activated (described above) and the entire fixture and module unit is lowered onto blocks or other supports 256. This is shown in FIG. 23. At this point, the weight of the structure is supported by the blocks 256 and not by the pedestals.

Next, the fixture 88 is collapsed inside the module. As shown in FIGS. 24 and 25, the jacking truss operating mechanisms 170 consisting of hydraulic cylinders 176 and 177 are actuated and the foldable linkages 124 are collapsed. Of course, prior to activation of the cylinders 176 and 177, the pins 182 are withdrawn (through activation of hydraulic cylinders 186 described above) and bolts 196 in the slots 194 in plate hubs 116 are loosened (also as described above). The resulting collapse of the fixture 88 results in a sizeable space (D in FIG. 25) being formed between the top of the spider and the inner surface of the module shell 56.

As the next step, the pedestal jacking beam mechanisms 240 and 242 are again actuated and the spider which is now free from the module shell is raised approximately one-half the distance D formed by the collapse. This is shown in FIG. 26. At this point, the wheel mechanisms 146 shown in FIGS. 27 and 28 are lowered into operating position and a series of roller mechanisms 258 are installed. The wheel mechanisms 146 are described above and each comprise a wheel 260 arranged in a support 262 which is pivotably mounted at one end by member 264 on one of the beams or girders 265 of the fixture 88. The other end of support 262 is mounted in its "up" position by pin member 266 and adapted to be secured in its lowered position by pin member 268.

Figure 32:
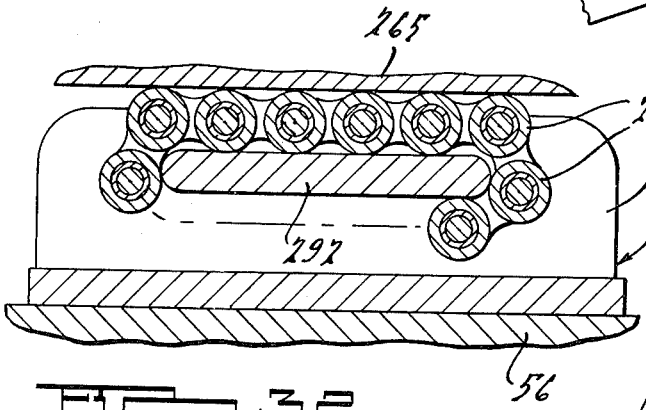
FIG. 32 is a cross-sectional view of one of the roller mechanisms, and is viewed in the direction of the arrows 32—32 of FIG. 31.

The roller mechanisms 258 are preferably of the type manufactured by the Hillman Equipment Company and are shown in more detail in FIG. 32. The mechanisms each have an endless chain track of cylindrically-shaped rollers 290 positioned around a bar 292 in a strong housing 294. As shown in FIG. 28, the roller mechanisms are welded in position directly beneath an I-beam 265 which extends the length of the fixture 88. Two rows of three or four roller mechanisms 258 are provided along the length of fixture 88. They are positioned beneath an I-beam 265 so that the fixture can be removed easily and without damage by rolling it along the rollers 260. Later, after the spider is removed from the module, the Hillman rollers are knocked off from the shell for reuse.

Figure 31:
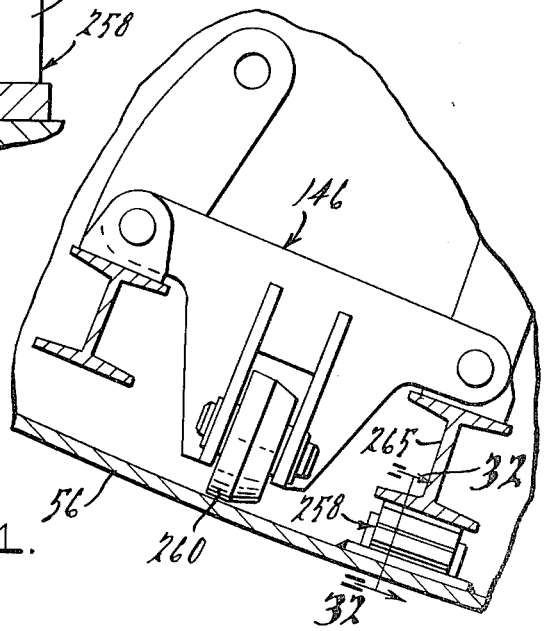
FIG. 31 shows the fixture resting on the roller mechanisms for removal from the shell.

After the wheel mechanisms 146 are lowered into position and the Hillman roller mechanisms 258 are installed in position, the pedestal jacking beam mechanisms are actuated further. The mechanisms 240 and 242 are actuated to lower the collapsed fixture onto the Hillman rollers, as shown in FIG. 31. The wheels 260 are not quite touching the shell 56 at this stage so that no damage will be done to the shell.

Since the module is now resting on supports 256 and the fixture is resting via the roller mechanisms on the inside surface of the module shell, the pedestals 156 and 158 are no longer required. Thus, pedestal 158 is now detached from its supports, slid backwards, and removed completely from the area.

In order to remove the spider from the module, a roll-out table 267 is provided. As shown in FIGS. 23 and 33–35, the roll-out table is positioned opposite the access tower 198 and supported on footings 269. The table 267 comprises a pair of tracks 270 and 272 made from steel I-beams supported by a framework 274 of other beams and girders. The tracks 270 and 272 are arranged in line with the rows of wheels 260 so that the wheels will rest, roll on and be supported by the tracks when the spider is pulled out from the module. A close-up view of wheel 260 after the spider has been rolled out onto the roll-out table 267 is shown in FIG. 36. In order to ensure that the wheels 260 remain on the tracks when the fixture is rolled out, retaining ridges or flanges (not shown) can be welded along the length of the upper surfaces of I-beams 270 and 272.

The spider 88 is preferably pulled and rolled out from the module by means of a cable and winch mechanism although it is understood that there are various other ways in which the fixture can be removed or pulled out. If a winch is utilized, it can be positioned at the furthest end of the roll-out table away from the module or at least at a point which allows the fixture to be pulled out completely from the module at one time.

Figures 33, 35:
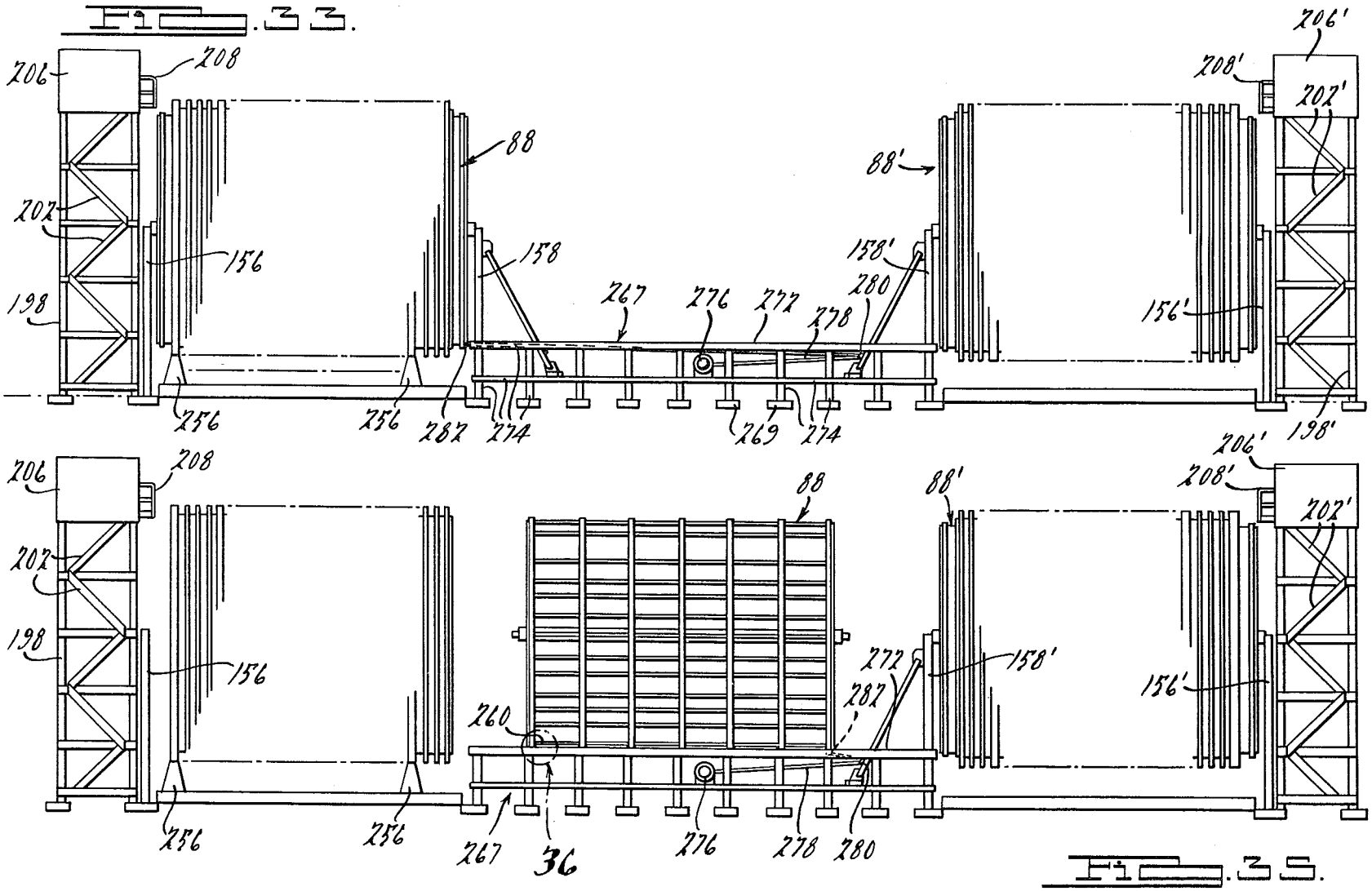
FIG. 33 is a side view of the dual-purpose roll-out table.
FIG. 35 is a side view of the roll-out table after a fixture has been removed from a module.
Figure 34:
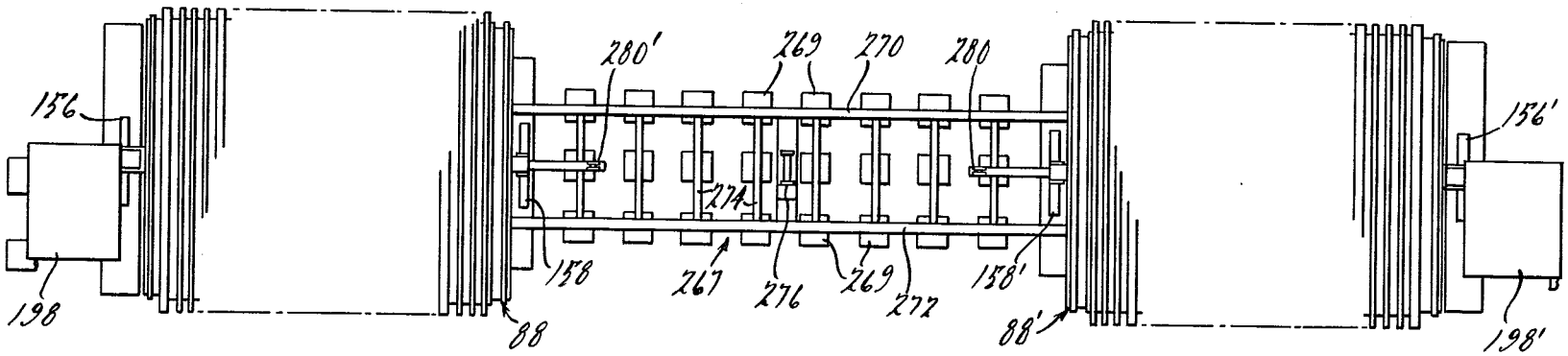
FIG. 34 is a top view of the roll-out table of FIG. 33.
Figure 36:
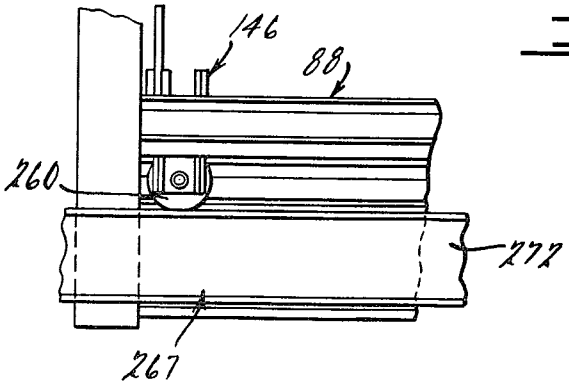
FIG. 36 is an enlarged view of the encircled area of FIG. 35 showing the removal wheel members on the roll-out table.

Preferably the roll-out table 266 and removal winch have dual-purpose abilities as shown in FIGS. 33–35. The roll-out table is situated between two sets of similar pedestals (156, 158 and 156', 158') and used to roll out the fixtures 88 and 88' from adjacent modules when they are finished. This feature conserves space and materials at the building site. The access towers 198 and 198' on each side of the roll-out table, as well as the other features relating to each of the pedestal arrangements, are the same.

A common winch 276 is utilized for the dual-purpose roll-out table and is situated approximately in the center thereof. In order to remove one of the fixtures, such as the one shown inside the left-hand module in FIGS. 33–35, the cable 278 from the winch is passed first around a pulley mechanism 280 on the opposite removable pedestal 158' and then attached to the fixture 88 at connection point 282. Activation of the winch 276 will then pull out the fixture from the module and roll it onto the tracks 270 and 272 on the roll-out table 266.

The common winch 276 can also be used to slide back pedestals 158 (and 158') so they can be removed from the pull-out area. Preferably, the removal of pedestals 158 and 158', as well as the placement of plate 56' on the roll-out table 80, the position of spider 88 on the plate 56', and the placement of the shell and fixture unit on the pedestal, is accomplished by the use of a large crane.

When it is necessary to remove fixture 88' from the right-hand module in FIGS. 33–35, the procedure which was used to remove fixture 88 is repeated in a similar fashion. The winch cable 278 is passed around a pulley mechanism 280' on pedestal 158 (which has been secured back in place) and then attached to fixture 88'.

It is also believed that the general principles and features of the present invention may be equally applicable to the construction of other similar generally cylindrical structures.

While it is apparent that the preferred embodiments illustrated herein are well calculated to fulfill the objects above stated, it will be appreciated that the present invention is susceptible to modification, variation and change without departing from the scope of the invention, as defined by the following claims.

We claim:

1. A process for manufacture of tunnel tube modules comprising the steps of:

(a) rolling up a flat steel plate around a collapsible fixture into a cylindrical shell, said fixture having a plurality of wheel mechanisms thereon, (b) positioning said fixture and shell onto supports for rotation, (c) assembling a support framework on the external surface of said shell, (d) lowering said fixture and shell onto base means, (e) collapsing said fixture within said shell, (f) raising up said collapsed fixture within said shell, (g) lowering the wheel mechanisms into operating positions, and (h) removing the fixture from said shell.

2. The process as set forth in claim 1 further comprising the step of positioning roller mechanisms in said shell when said wheel mechanisms are lowered into operating position.

3. The process as set forth in claim 1 further comprising the step of rolling said fixture onto a roll-out table when said fixture is removed from said shell, said roll-out table being positioned adjacent one end of said shell.

4. The process as set forth in claim 1 wherein said fixture is removed from said shell by being pulled out by winch means.

5. The process as set forth in claim 3 wherein said fixture is removed from said shell by being pulled out by winch means.

* * * * *

UNITED STATES PATENT AND TRADEMARK OFFICE

CERTIFICATE OF CORRECTION

PATENT NO. : 4,462,535

DATED : July 31, 1984

INVENTOR(S) : Edward Johnson, et al

It is certified that error appears in the above-identified patent and that said Letters Patent is hereby corrected as shown below:

| | |
|---|---|
| Abstract line 7 | "use" should be --used-- |
| Column 6, line 58, | "hug" should be --hub-- |
| Column 10, line 13, | add --safe-- after "have" |
| Column 10, line 29, | "guide" should be --glide-- |
| Column 10, line 30, | "229" should be --220-- |
| Column 11, line 10, | after "56" delete --is-- |

Signed and Sealed this

*Twenty-eighth* Day of *May 1985*

[SEAL]

*Attest:*

DONALD J. QUIGG

*Attesting Officer* *Acting Commissioner of Patents and Trademarks*